US011817276B2

(12) United States Patent
Rocca et al.

(10) Patent No.: US 11,817,276 B2
(45) Date of Patent: Nov. 14, 2023

(54) LOW VOLTAGE SWITCHING DEVICE

(71) Applicant: ABB S.p.A., Milan (IT)

(72) Inventors: Claudio Rocca, Treviglio (IT); Mauro Ghislotti, Mapello (IT)

(73) Assignee: ABB S.p.A., Milan (IT)

( * ) Notice: Subject to any disclaimer, the term of this patent is extended or adjusted under 35 U.S.C. 154(b) by 210 days.

(21) Appl. No.: 17/049,047

(22) PCT Filed: Apr. 17, 2019

(86) PCT No.: PCT/EP2019/059920
§ 371 (c)(1),
(2) Date: Oct. 20, 2020

(87) PCT Pub. No.: WO2019/201992
PCT Pub. Date: Oct. 24, 2019

(65) Prior Publication Data

US 2021/0241985 A1 Aug. 5, 2021

(30) Foreign Application Priority Data

Apr. 20, 2018 (EP) ..... 18168461

(51) Int. Cl.
*H01H 71/50* (2006.01)
*H01H 1/20* (2006.01)
(Continued)

(52) U.S. Cl.
CPC ..... *H01H 21/30* (2013.01); *H01H 1/14* (2013.01); *H01H 1/2041* (2013.01); *H01H 21/50* (2013.01); *H01H 71/205* (2013.01)

(58) Field of Classification Search
None
See application file for complete search history.

(56) References Cited

U.S. PATENT DOCUMENTS 5,300,907 A * 4/1994 Nereau ..... H01H 1/2058 335/190
9,171,684 B2 * 10/2015 Bunk ..... H01H 71/505

FOREIGN PATENT DOCUMENTS

DE 4442417 C1 2/1996
DE 102006059307 B3 2/2008
(Continued)

OTHER PUBLICATIONS

European Patent Office, International Search Report & Written Opinion issued in corresponding Application No. PCT/EP2019/059920, dated Jun. 24, 2019, 15 pp.
(Continued)

*Primary Examiner* — Felix O Figueroa
(74) *Attorney, Agent, or Firm* — Armstrong Teasdale LLP

(57) ABSTRACT

Described herein is a low voltage switching device including: one or more electric poles having one or more movable contacts and corresponding fixed contacts adapted to be coupled to or uncoupled from each other; a movable contact assembly including said movable contacts and a main supporting and operating shaft reversibly movable between a first contact position, at which said movable contacts and said fixed contacts are uncoupled, a second contact position, at which said movable contacts and said fixed contacts are coupled, and a third contact position, at which said movable contacts and said fixed contacts are coupled and kept pressed; an operating assembly including a handle mechanism having a handle adapted to be reversibly moved by a user or a motor operated actuator (MOE) between a first, open position and a second, closed position; and a driving assembly operatively connected to said operating assembly.

9 Claims, 22 Drawing Sheets

(51) Int. Cl.

| | |
|---|---|
| ***H01H 21/30*** | (2006.01) |
| ***H01H 1/14*** | (2006.01) |
| ***H01H 21/50*** | (2006.01) |
| ***H01H 71/20*** | (2006.01) |

(56) References Cited

FOREIGN PATENT DOCUMENTS

| | | | |
|---|---|---|---|
| EP | 0584503 | A1 | 3/1994 |
| EP | 2654064 | A1 | 10/2013 |
| EP | 2382645 | B1 | 11/2014 |
| EP | 1442467 | B1 | 3/2015 |

OTHER PUBLICATIONS

European Patent Office, Extended Search Report issued in corresponding Application No. 18168461.4, dated Oct. 11, 2018, 8 pp.
Indian Patent Office, Examination Report issued in corresponding Application No. 202047044947, dated Mar. 30, 2021, 5 pp.

* cited by examiner

LOW VOLTAGE SWITCHING DEVICE

The present invention relates to the field of switching devices (such as circuit breakers, contactors, disconnectors and the like) for low voltage electric installations. For the purposes of the present application, the term "low voltage" relates to operating voltages lower than about 2 kV.

As is known, switching devices for low voltage electric installations comprise one or more electric poles intended to be electrically connected to the conductors of a low voltage electric line. Each electric pole comprises one or more mobile contacts and corresponding fixed contacts that can be mutually coupled/uncoupled.

Typically, a low voltage switching device comprises mechanical control means adapted to provide an actuation force to move the mobile contacts from a coupling position to an uncoupling position with the corresponding fixed contacts, or vice-versa.

In most low voltage switching devices the mentioned mechanical control means comprise an outer operating handle, which is intended to be operated by a user or an actuator (e.g. a MOE—Motor Operated Actuator) to perform an opening or a closing manoeuvre of the switching device.

An example of an existing low voltage switching device is given in the attached FIGS. 1-4 that show the operating sequence during a closing operation. With reference to such figures, the low voltage switching device comprises at least an electric pole 10, which comprises a pair of movable contacts 11 and a pair of corresponding fixed contacts 12 which are adapted to be coupled to or uncoupled from each other.

The low voltage switching device further comprises a movable contact assembly comprising said movable contacts 11 and a main supporting and operating shaft 13 which is reversibly movable between a first contact position, at which said movable contacts 11 and said fixed contacts 12 are uncoupled (FIG. 1), a second contact position, at which said movable contacts 11 and said fixed contacts 12 are coupled (FIG. 2), and a third contact position, at which said movable contacts 11 and said fixed contacts 12 are coupled and kept pressed (FIG. 3).

Moreover, the low voltage switching device comprises an operating assembly comprising a handle mechanism having a handle 14 adapted to be reversibly moved by a user or a motor operated actuator (MOE) between a first, open, position (FIG. 1) and a second, closed, position (FIG. 3).

The operating assembly and the movable contact assembly are operatively coupled by a driving assembly which comprises a kinematic chain 15 and at least a driving spring 16, said driving assembly reversibly moving said movable contact assembly following a movement of said operating assembly from said open position to said closed position, as shown in the sequence from FIG. 1 to FIG. 3 in which a correct closing sequence is shown. As shown in FIG. 3, in the correct closed position the supporting and operating shaft 13 is extra-rotated with respect to the movable contacts 11 of a certain angle that allows keeping the movable contacts 11 pressed against the fixed contacts 12.

However, with reference to FIG. 4, if the closing manoeuvre of the switching device is carried out slowly, e.g. if the speed of the operating handle 14 is too slow with respect to the rotation speed of the supporting and operating shaft 13, it may happen that the resistance generated by the contacts 11 and 12 during the closing operation prevents the driving assembly from completing correctly the operation, thereby leaving the low voltage switching device in the situation of FIG. 4.

In such conditions, even if the handle 14 is in the closed position, the driving assembly and the movable contact assembly has not reached the closed position and the supporting and operating shaft 13 is not extra-rotated with respect to the movable contacts 11. Therefore, little or no pressure is exerted on the movable contacts 11, thereby leading to a potentially dangerous situation.

Such problem normally does not arise when a MOE is used, since in such a case the speed of the operating assembly is much higher and allows to carry out the so called "quick manoeuvre". Conversely, when the operating handle 14 is manually operated it is possible that a too slow actuation speed of the handle bring about the incorrect situation of FIG. 4. Put in other terms, when the "quick manoeuvre" is carried out, the kinetic energy accumulated by the shaft is sufficient to overcome the resistance generated by the contacts 11 and 12; then the supporting and operating shaft 13 extra-rotates with respect to the movable contacts 11 of a certain angle that allows keeping the movable contacts 11 pressed against the fixed contacts 12. In case of "slow manoeuvre" the energy accumulated by the shaft is much less and maybe insufficient to complete correctly the manoeuvre, thereby leading to the situation of FIG. 4 A possible solution would be to over-dimension the driving spring 16, but this brings about an increase of the stresses on the various components, as well as an increase of the manufacturing costs.

On the basis of the above considerations, there is a need to have available alternative technical solutions that will enable the limits and the problems set forth above to be overcome. Hence, the present disclosure is aimed at providing a low-voltage switching device, which allows overcoming at least some of the above-mentioned shortcomings.

In particular, the present invention is aimed at providing a low-voltage switching device which is able to complete correctly the closing operation, independently from the speed of actuation of the operating handle.

Furthermore, the present invention is aimed at providing a low-voltage switching device in which the risk of having the contact incorrectly pressed at closing is avoided or at least greatly reduced.

Moreover, the present invention is aimed at providing a low-voltage switching device in which the driving springs do not need to be over-dimensioned in order to ensure proper functioning during the closing operation.

In addition, the present invention is aimed at providing a low-voltage switching device in which the kinetic energy stored in the main operating shaft always guarantee a correct functioning during the closing operation.

Also, the present invention is aimed at providing a low-voltage switching device, that is reliable and relatively easy to produce at competitive costs.

Thus, the present invention relates to a low voltage switching device which comprises:

- one or more electric poles, each electric pole comprising one or more movable contacts and one or more corresponding fixed contacts adapted to be coupled to or uncoupled from each other;
- a movable contact assembly comprising said mobile contacts and a main supporting and operating shaft reversibly movable between a first contact position, at which said movable contacts and said fixed contacts are uncoupled, a second contact position, at which said movable contacts and said fixed contacts are coupled, and a third contact position, at which said movable contacts and said fixed contacts are coupled and kept pressed;

an operating assembly comprising a handle mechanism having a handle adapted to be reversibly moved by a user or a motor operated actuator (MOE) between a first, open, position and a second, closed, position;

a driving assembly operatively connected to said operating assembly and to said movable contact assembly and comprising a kinematic chain and at least a driving spring, said driving assembly reversibly moving said movable contact assembly following a movement of said operating assembly from said open position to said closed position.

The low voltage switching device of the present invention is characterized in that said driving assembly comprises a latching mechanism which is operatively coupled to said operating assembly and to said movable contact assembly, said latching mechanism interacting with said movable contact assembly and latching it in said first contact position during a first phase of the movement of said operating assembly between said first, open, position and said second, closed, position, then unlatching said movable contact assembly when said operating assembly is in an intermediate position between said first, open, position and said second, closed, position, thereby allowing the quick passage of said movable contact assembly from said first contact position to said third contact position in which said movable contacts and said fixed contacts are coupled and kept pressed.

As better explained in the following description, thanks to the particular structure of the low-voltage switching device of the present invention, the above-mentioned problems can be avoided, or at least greatly reduced.

In brief terms, in the low-voltage switching device of the present invention the dynamic of the closing operation is always independent from the dynamic of actuation of the operating assembly. Indeed, the latching device allows the energy of the driving spring to be transmitted to the main supporting and operating shaft abruptly and in the most suitable instant during the closing operation. The main supporting and operating shaft is therefore always provided with the proper kinetic energy so as to ensure a correct closing operation independently from the actuation speed of the operating handle.

In other words, irrespective form the conditions of actuation of the operating assembly, in the low voltage circuit breaker of the present invention the main supporting and operating shaft is always provided with sufficient energy so as to extra-rotate with respect to the movable contacts once they are in the coupled position with the corresponding fixed contacts. The main supporting and operating shaft is therefore always capable to reach the proper pressing angle and ensure the proper pressing action on the contacts.

It is therefore not necessary to over-dimension the operating springs in order to always ensure a proper functioning of the circuit breaker during the closing operation. Conversely, the presence of the latching mechanism in the low-voltage switching device of the present invention allows to use driving springs which are less loaded thereby greatly reducing the mechanical load and stresses on the various component part of the driving system and of the circuit breaker as a whole.

In turn, this situation brings about further advantages in terms of design and manufacturing costs. Indeed, since the mechanical load and stresses are now lower than in comparable prior art breaker, it is possible to use less valuable materials and/or thinner geometries for the manufacturing of the component parts of the driving system and of the circuit breaker, with consequent possible economical and dimensional advantages.

Moreover, since the driving springs are less loaded, the energy necessary to actuate them is lower and it is therefore possible to use MOE as well as other actuating accessories which are less powerful, with consequent further cost reduction.

In a typical embodiment of the low voltage switching device of the present invention, the movable contact assembly is rotationally movable around a rotation axis between said first, second and third contact position and the movable contacts follow the main supporting and operating shaft during the rotational movement of the movable contact assembly from said first to said second contact position in which they are coupled with the corresponding fixed contacts. Once they have reached the contact position against the fixed contacts, the movable contacts remain in such position while said main supporting and operating shaft moves from said second to said third contact position in which said movable contacts and said fixed contacts are coupled and kept pressed.

Preferably, the latching mechanism present in the circuit breaker of the invention comprises a latching element which is movable between a first latching position and a second un-latching position.

In such a case, said latching element is preferably moved from said first latching position to said second un-latching position by an operating lever which is connected to said handle mechanism. In other words, from a functional standpoint, in the circuit breaker of the present invention the un-latching action takes place when in the operating assembly the handle mechanism has reached a predetermined position.

Also, in a preferred embodiment of the invention, the driving spring is fixed on one or more elements of the kinematic chain so that during actuation of the operating assembly its axis moves in a plane substantially perpendicular to the rotation axis of the movable contact assembly. Typically, a first end of the driving spring can be conveniently fixed on a pivot point of said operating lever, while a second end is operatively connected to the movable contact assembly.

Preferably, said latching element can be conveniently provided with a latching portion which is adapted to cooperate with a driving lever operatively connected to said movable contact assembly. In practice, from a functional standpoint, in the circuit breaker of the present invention, the un-latching element acts on a driving lever of the driving assembly operatively connected to the movable contact assembly and keep it into place until in the operating assembly the handle mechanism has reached a predetermined position.

Advantageously, in a greatly preferred embodiment of the present invention, the driving lever of the driving assembly is rotationally hinged on a transverse axis and begins to move, i.e. it is un-latched, when the axis of the driving spring, i.e. the working axis of the spring along which it is compressed and extended, crosses said transverse axis. Preferably, a first end of the driving spring can be conveniently fixed on a pivot point of said operating lever, while a second end can be conveniently fixed on a pivot point on said driving lever which is operatively connected to the movable contact assembly.

For the purposes of the present invention the term transverse axis refers to an axis than runs parallel to the axis of rotation of the main supporting and operating shaft. In this way the transfer of energy is optimized and the kinetic energy accumulated by the main supporting and operating shaft is maximized.

In a first exemplary embodiment of the low voltage switching device the present invention said latching element is conveniently positioned on a fixed portion of said low voltage switching device.

In a further exemplary embodiment of the low voltage switching device the present invention, said latching element conveniently comprises a latching lever having a first end adapted to cooperate with a first operating lever connected to said handle mechanism and a second end having a latching portion adapted to cooperate with a first driving lever operatively connected to said movable contact assembly, as better explained in the following detailed description. For instance, in an embodiment of the low voltage switching device of the invention, a first end of said latching lever can cooperate with a shaft or a pin which is hinged on said first operating lever and the latching portion of the second end of said latching lever can cooperate with a shaft or a pin hinged on said first driving lever.

In a second exemplary embodiment of the low voltage switching device the present invention, said latching element is conveniently positioned on a movable part of said operating assembly.

In such a case, for example, the latching element can be conveniently fixed on a second operating lever connected to said handle mechanism. In particular, said latching element can be integrally made on a second operating lever connected to said handle mechanism, as better explained in the following detailed description. In practice, from a functional standpoint, also in this case the un-latching action takes place when in the operating assembly the handle mechanism has reached a predetermined position.

In a further embodiment of the low voltage switching device of the invention, said latching element is conveniently provided with a latching portion adapted to cooperate with a second driving lever operatively connected to said movable contact assembly. Thus, also in this embodiment, the un-latching element acts on a driving lever of the driving assembly operatively connected to the movable contact assembly and keep it into place until in the operating assembly the handle mechanism has reached a predetermined position.

For instance, in an embodiment of the low voltage switching device of the invention, the latching portion of said latching element can be conveniently adapted to cooperate with a shaft or pin hinged on said second driving lever, as better explained in the following detailed description.

Further features and advantages of the present invention will be more clear from the description of preferred but not exclusive embodiments of the low-voltage switching device of the present invention, shown by way of examples in the accompanying drawings, wherein.

Figure 22C:
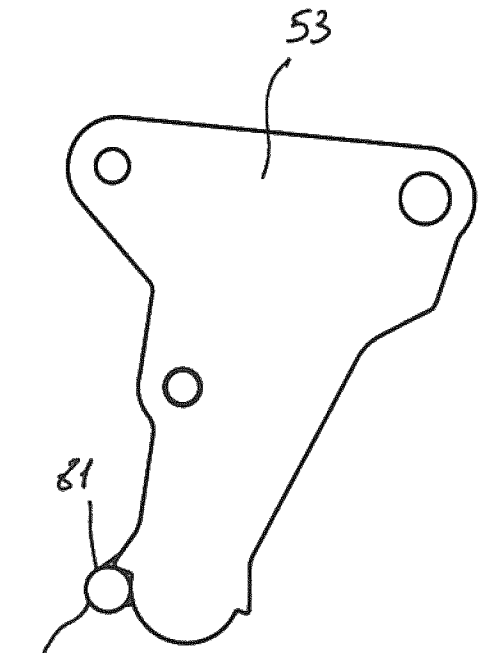
Figure 22B:
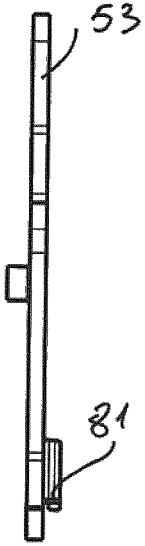
Figure 22A:
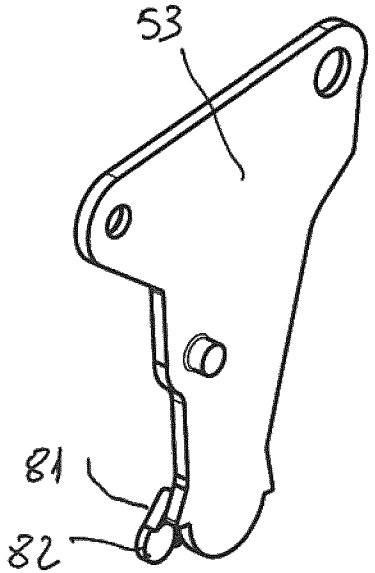

FIGS. 22*a*-22*c* are respectively a perspective view, a side view and a front view of a component of a second embodiment of a pole for a low-voltage switching device according to the invention.

Referring to the cited figures, the present invention relates to a switching device which is suitable to be installed in a low voltage electric switchgear panel or, more generally, in a low voltage electric power distribution grid. As a non-limiting example, the switching device may be an automatic MCCB (Molded Case Circuit Breaker) for low voltage applications, and the following description will be made with reference to a typical example of such kind of switching devices. Non limiting examples of low voltage switching devices, in which the present invention can be implemented, are described, e.g., in EP2382645, EP1883944, and EP3190600.

The low voltage switching device generally comprises one or more electric poles 1, 100, which in turn comprise one or more movable contacts 2 and one or more corresponding fixed contacts 3 which are adapted to be coupled to or uncoupled from each other, according to well-known embodiments.

The low voltage switching device further comprises a movable contact assembly 4 which comprises said movable contacts 2 and a main supporting and operating shaft 41. The movable contact assembly 4 is reversibly movable between a first contact position, at which said movable contacts 2 and said fixed contacts 3 are uncoupled, a second contact position, at which said movable contacts 2 and said fixed contacts 3 are coupled, and a third contact position, at which said movable contacts 2 and said fixed contacts 3 are coupled and kept pressed, as better explained hereinafter.

Furthermore, the low voltage switching device also comprises an operating assembly 5 comprising a handle mechanism having a handle 51 adapted to be reversibly moved by a user or a motor operated actuator (MOE) between a first, open, position and a second, closed, position.

The low voltage switching device is also provided with a driving assembly 6 which is operatively connected to said operating assembly 5 and to said movable contact assembly 4 and which comprises a kinematic chain 61 and at least a driving spring 62. The driving assembly 6 is adapted to reversibly move said movable contact assembly 4 following a movement of said operating assembly 5 from said open position to said closed position, and vice-versa.

In general, the pole structure and the structure of the movable contact assembly, the operating assembly and the driving assembly of a low voltage switching device are well known in the art and will not be described with further details.

One of the distinguishing features of the low voltage switching device of the present invention is given by the fact that said driving assembly 6 advantageously comprises a latching mechanism 7, 8 which is operatively coupled to said operating assembly 5 and to said movable contact assembly 4.

As better explained hereinafter, the latching mechanism 7, 8 interacts with said movable contact assembly 4 and keep it latched in said first contact position during a first phase of the movement of said operating assembly 5 between said first, open, position and said second, closed, position. Then, the latching mechanism 7, 8 unlatches said movable contact assembly 4 when said operating assembly 5 is in an intermediate position between said first, open, position and said second, closed, position, thereby allowing the quick passage of said movable contact assembly 4 from said first contact position to said third contact position in which said movable contacts 2 and said fixed contacts 3 are coupled to each other and kept pressed against each other.

According to a general typical embodiment of the low voltage switching device of the invention, the movable contact assembly 4 is rotationally movable around an axis 40 between said first, second and third contact position. The movable contacts 2 are operatively connected to said main supporting and operating shaft 41 and follow it during the rotational movement of said movable contact assembly 4 from said first to said second contact position in which said movable contacts 2 are coupled with the corresponding fixed contacts 3. Then, the movable contacts 2 remain in the coupled position with the fixed contacts 3 while the main supporting and operating shaft 41 slightly continues to rotates of a certain angle (pressing angle) and moves from said second to said third contact position in which said movable contacts 2 and said fixed contacts 3 are coupled to each other and kept pressed against each other.

The driving spring 62 is preferably fixed on one or more elements of the kinematic chain including the operating assembly 5, the driving assembly 6 and the movable contact assembly 4, so that during actuation of the operating assembly 5 its axis 65 moves in a plane substantially perpendicular to the rotation axis 40 of the movable contact assembly 4. Advantageously, the latching mechanism 7, 8 generally comprises a latching element which is movable between a first latching position and a second un-latching position. Exemplary embodiments of latching element 71, 81 will be described hereinafter.

Preferably, said latching element 71, 81 is moved from said first latching position to said second un-latching position by an operating lever 52, 53 which is connected to said handle mechanism. Moreover said latching element 71, 81 is conveniently provided with a latching portion 72, 82 which is adapted to cooperate with a driving lever 63, 64 operatively connected to said movable contact assembly 4.

Preferably, one end of the driving spring 62 can be conveniently fixed on a pivot point of said operating lever 52, 53, while the other end is operatively connected to the movable contact assembly 4.

In particular, the driving lever 63, 64 is rotationally hinged on a transverse axis 66, 67 which is substantially parallel to the axis of rotation of the movable contact assembly. The driving lever 63, 64 advantageously begins to move when the axis 65 of the driving spring 62 crosses said transverse axis 66, 67.

In a preferred embodiment a first end of said driving spring 62 is fixed on a pivot point of said operating lever 52, 53, while a second end of said driving spring 62 is fixed on a pivot point on said driving lever 63, 64 which is operatively connected to the movable contact assembly 4.

The functioning of a first exemplary embodiment of a low voltage switching device according to the invention will be now described with reference to FIGS. 5-10 and 11-16.

In such embodiment, the low voltage switching device is provided with a latching element 71 which is positioned on a fixed portion of said low voltage switching device. In particular, the latching element is hinged on a shaft which has a fixed position inside the switching device. Said latching element 71 comprises a latching lever which has a first end 73 adapted to cooperate with a first operating lever 52 connected to said handle mechanism and a second end 74 which has a latching portion 72 adapted to cooperate with a first driving lever 63 operatively connected to said movable contact assembly 4. The first driving lever 63 is rotationally hinged on a transverse axis 66 parallel to the rotation axis 40 of the movable contact assembly 4. A first end of the driving spring 62 is fixed on a pivot point of said first operating lever 52, in this case a shaft 520, while a second end of said driving spring 62 is fixed on a pivot point on said first driving lever 63 which is operatively connected to the movable contact assembly 4.

More in details, the first end 73 of said latching lever cooperates with a shaft 520 which is hinged on said first operating lever 52 and follows said first operating lever 52 during its movement under the action of the handle 51. The latching portion 72 of the second end 74 of said latching lever in turn cooperates with a shaft 630 which is hinged on said first driving lever 63, as explained hereinafter.

Figure 1:
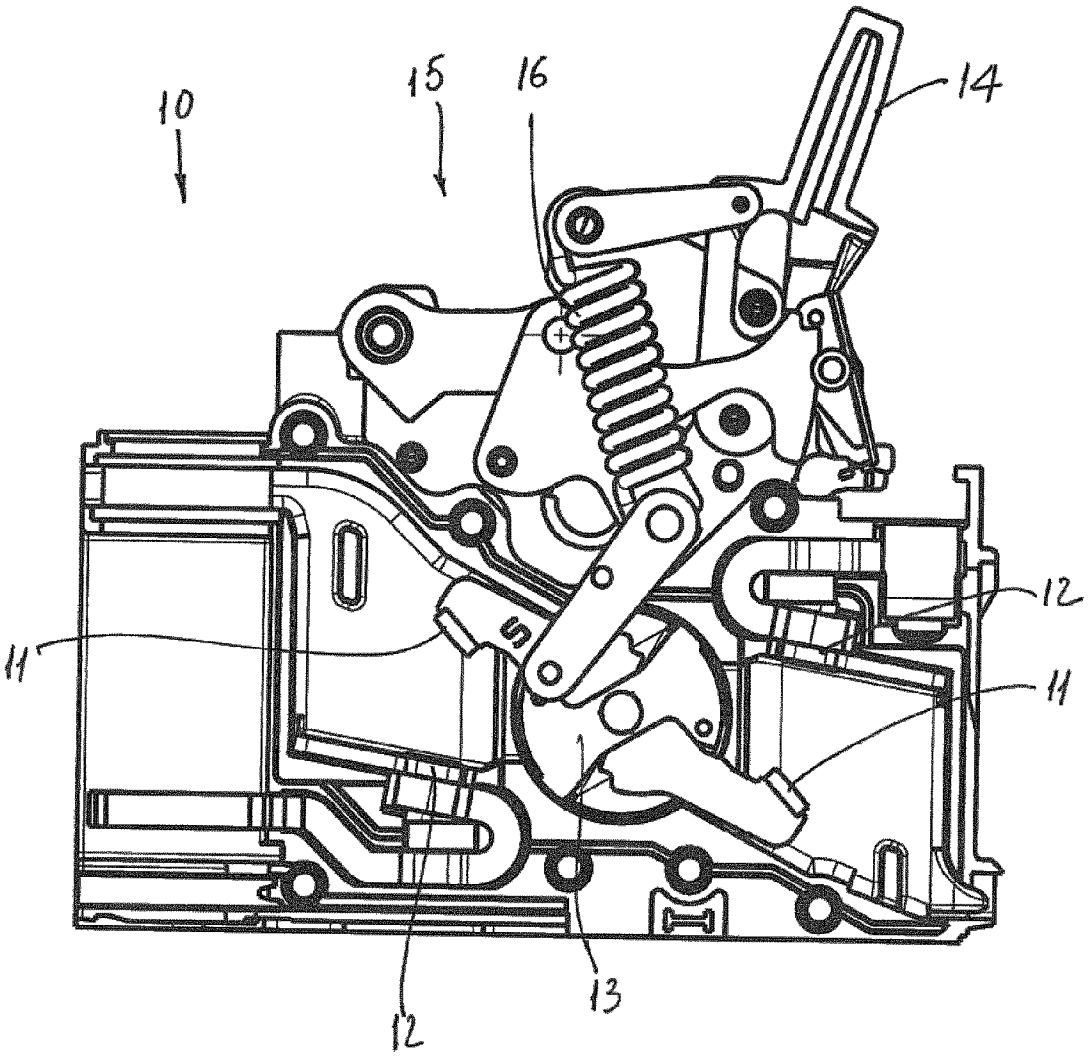
Prior Art FIG. 1
FIG. 1 is a side view of a prior art embodiment of a pole for a low-voltage switching device in the open position.
Figure 2:
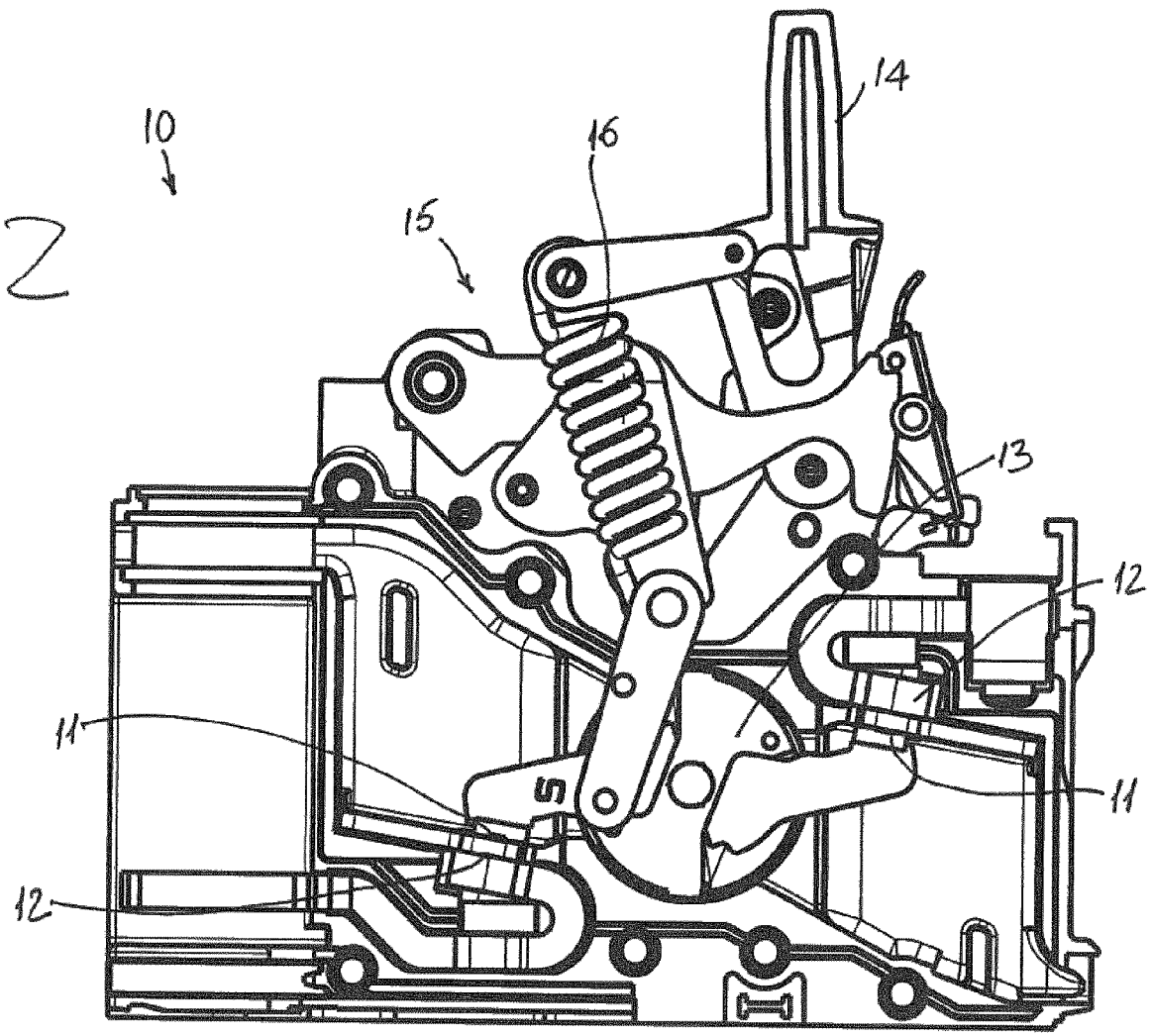
FIG. 2 Prior Art
FIG. 2 is a side view of a prior art embodiment of a pole for a low-voltage switching device in during a closing operation.
Figure 3:
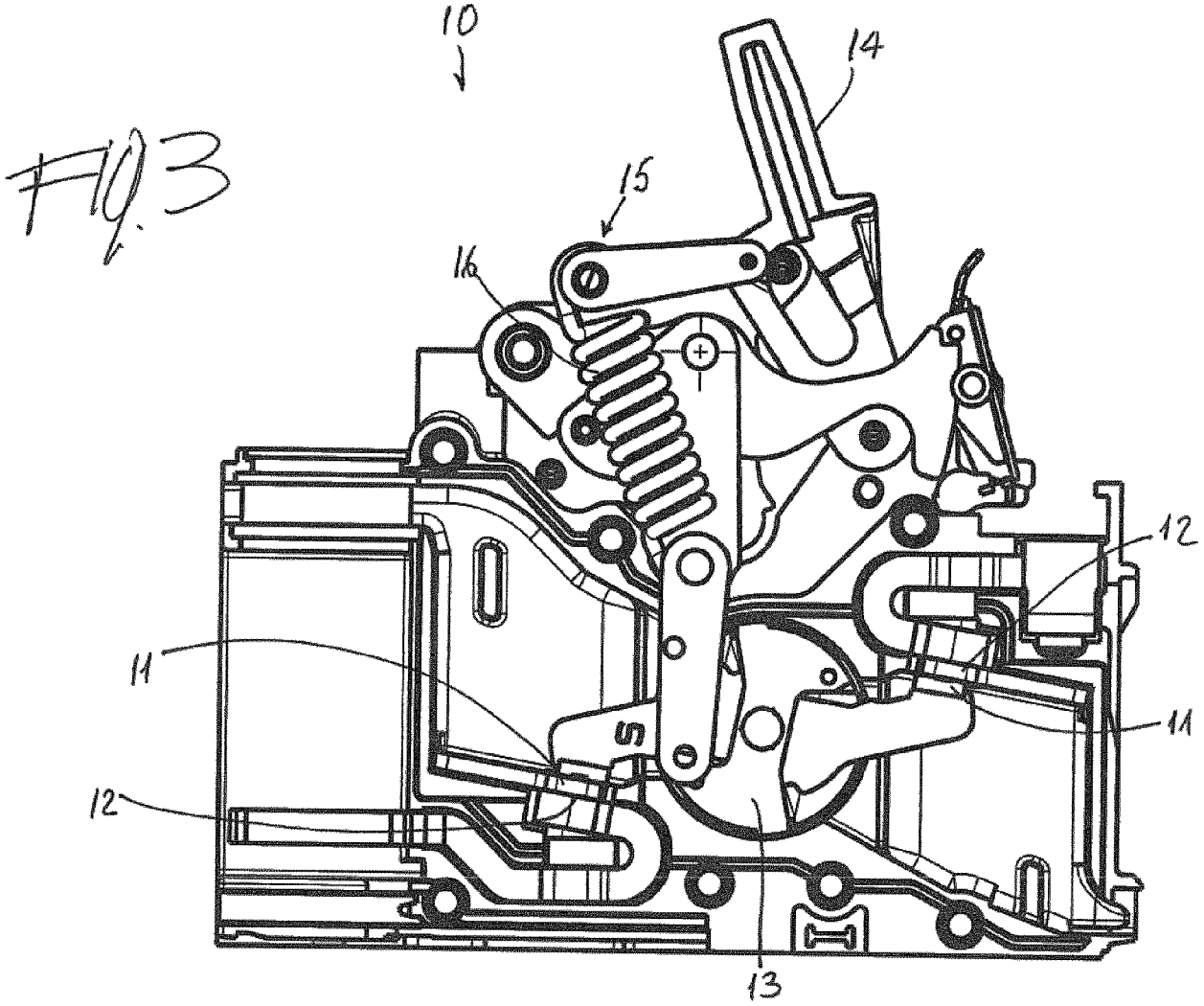
Fig. 3 Prior Art
FIG. 3 is a side view of a prior art embodiment of a pole for a low-voltage switching device in the correct closed position.
Figure 4:
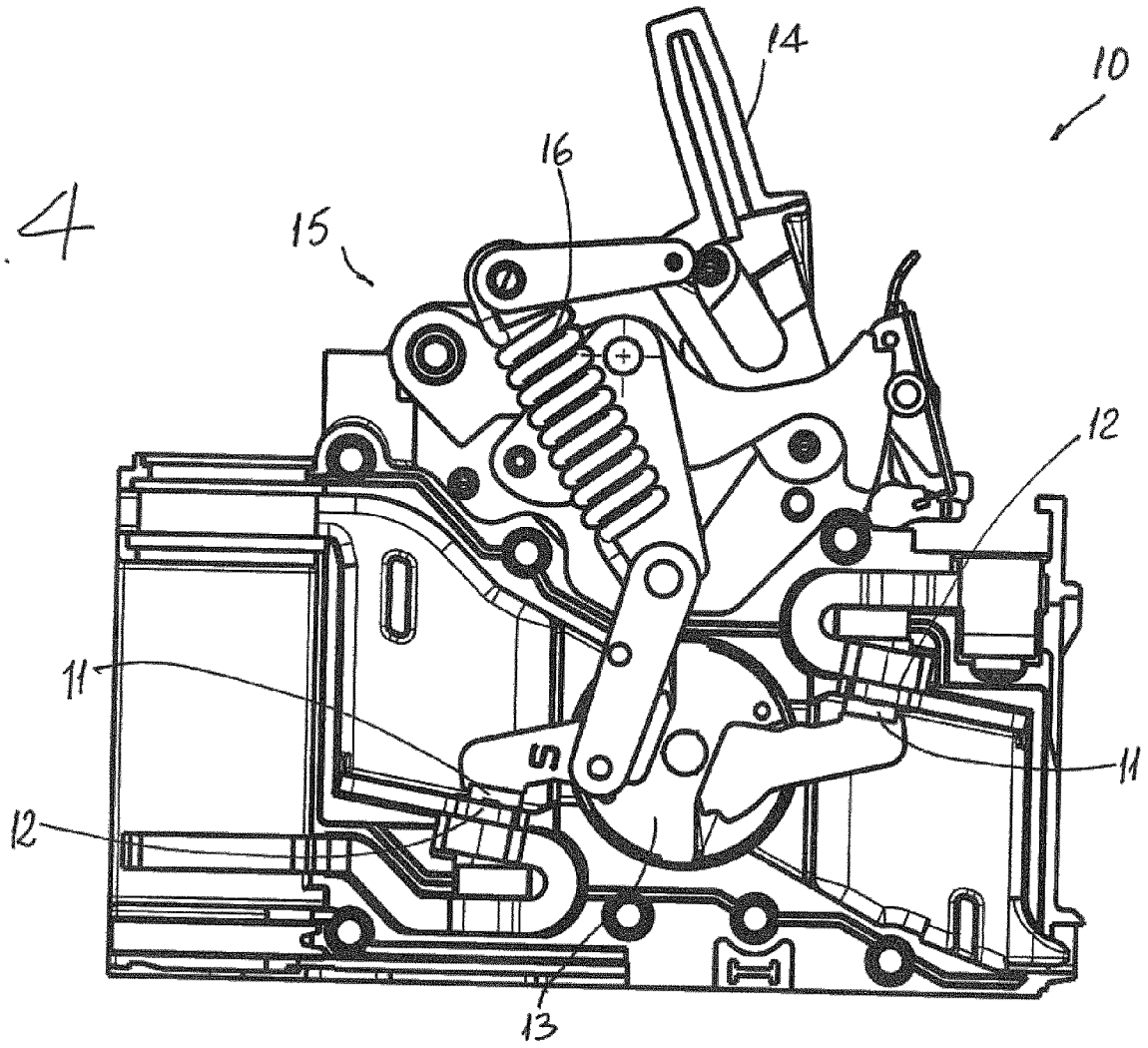
Fig. 4 Prior Art
FIG. 4 is a side view of a prior art embodiment of a pole for a low-voltage switching device in an incorrect closed position.
Figure 5:
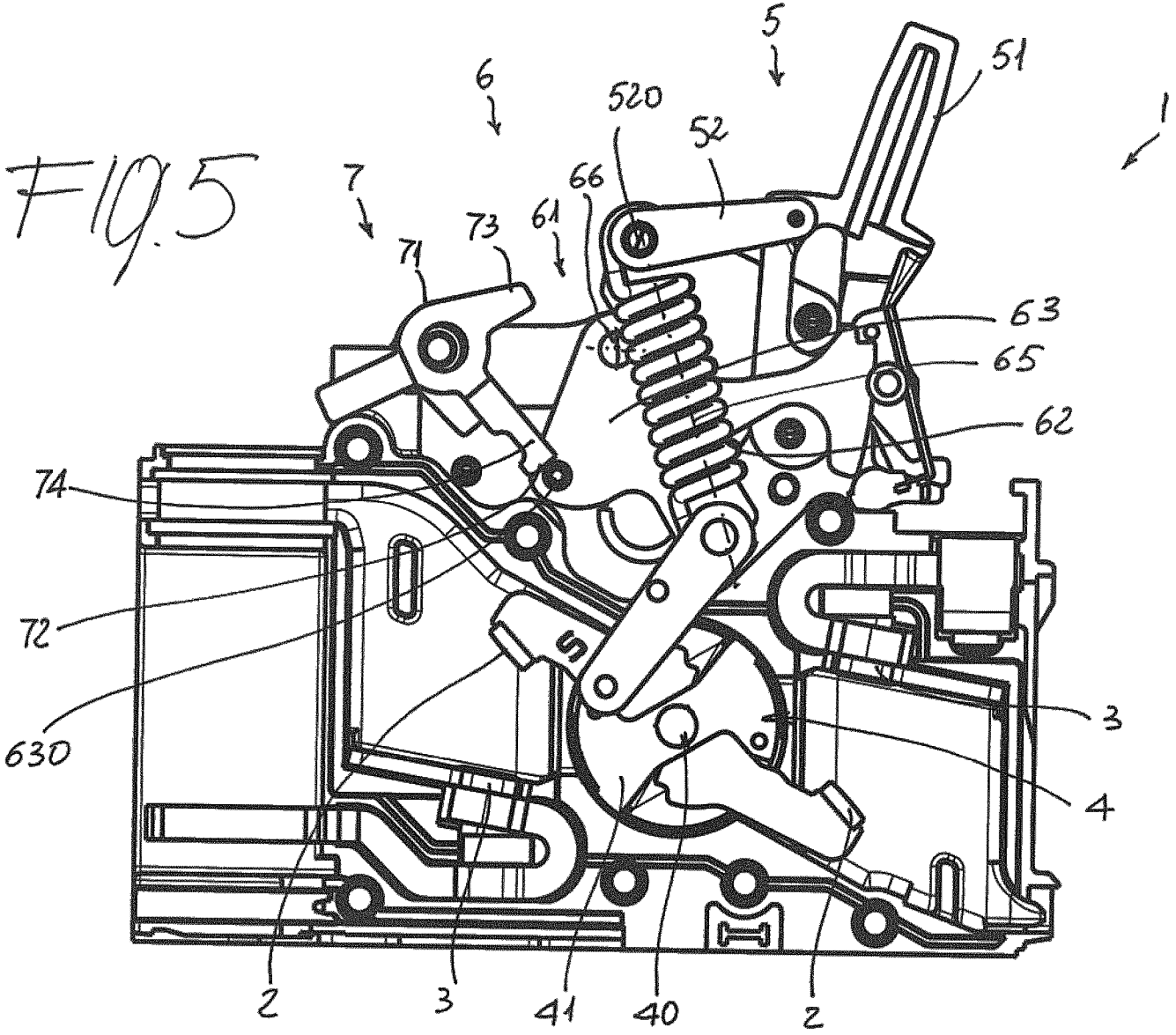
FIG. 5 is a side view of a first embodiment of a pole for a low-voltage switching device according to the invention, shown in the open position.
Figure 6:
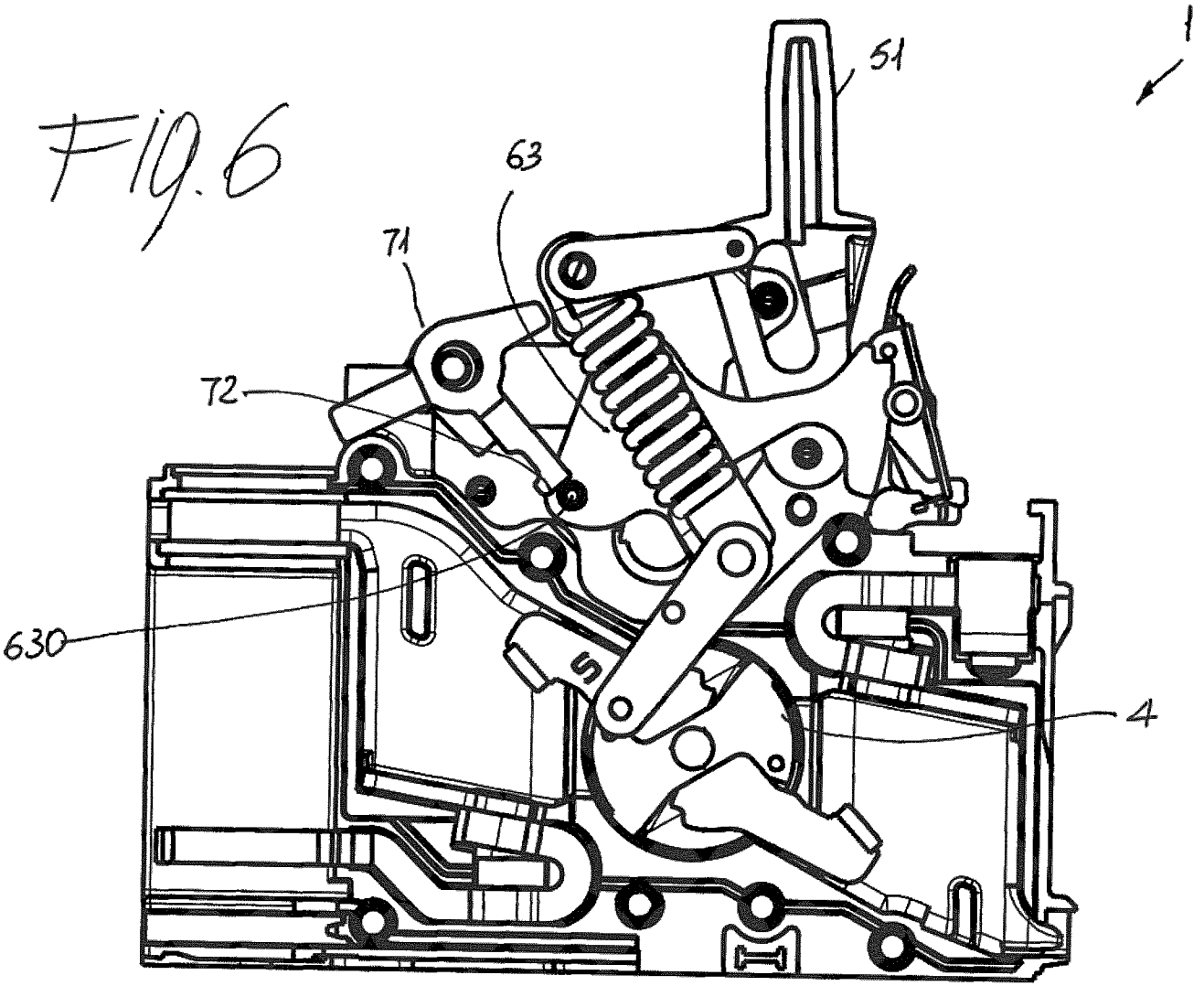
FIGS. 6-9 are side views of a first embodiment of a pole for a low-voltage switching device according to the invention, representing different successive stages of the closing operation.
Figure 7:
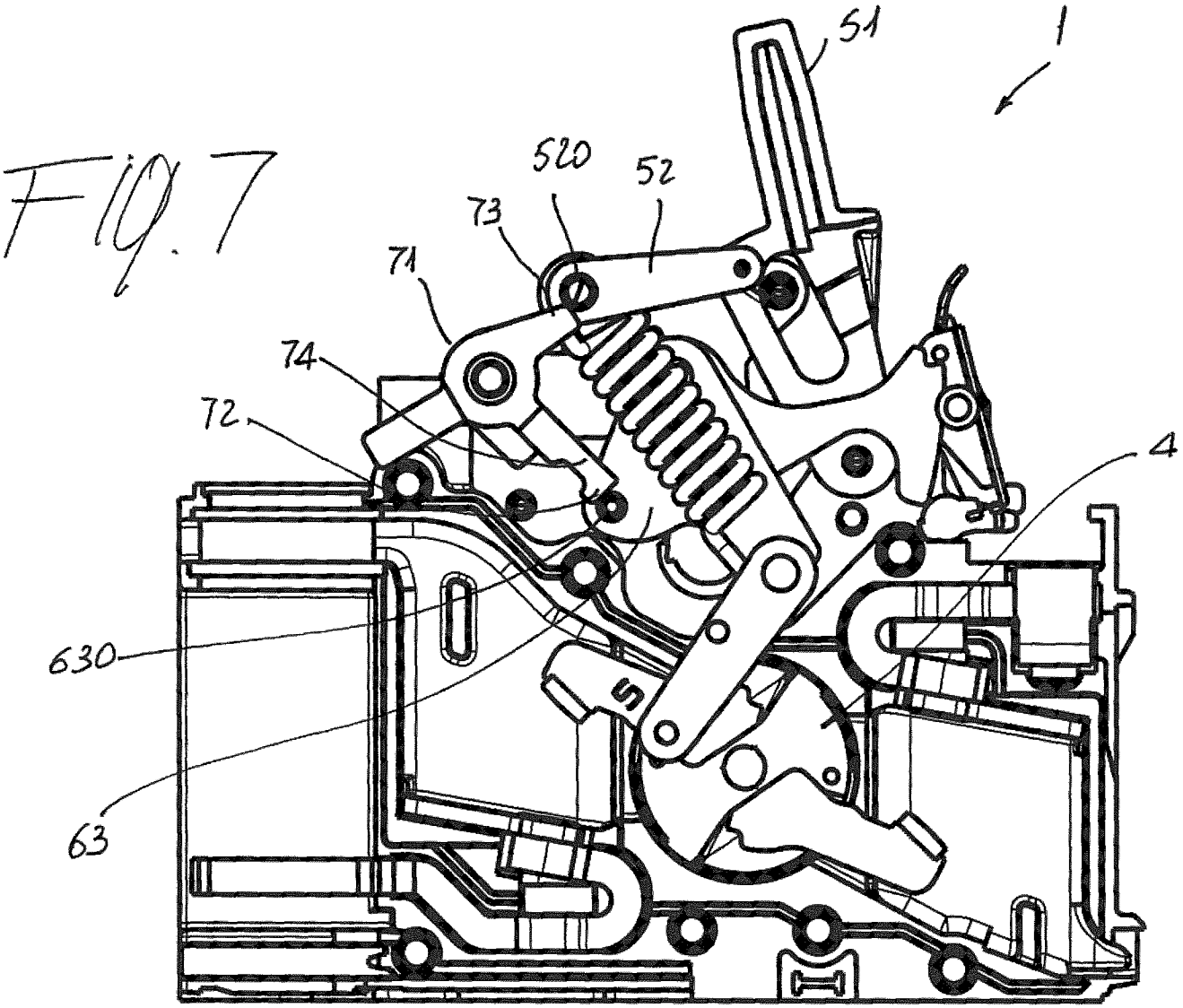
Figure 8:
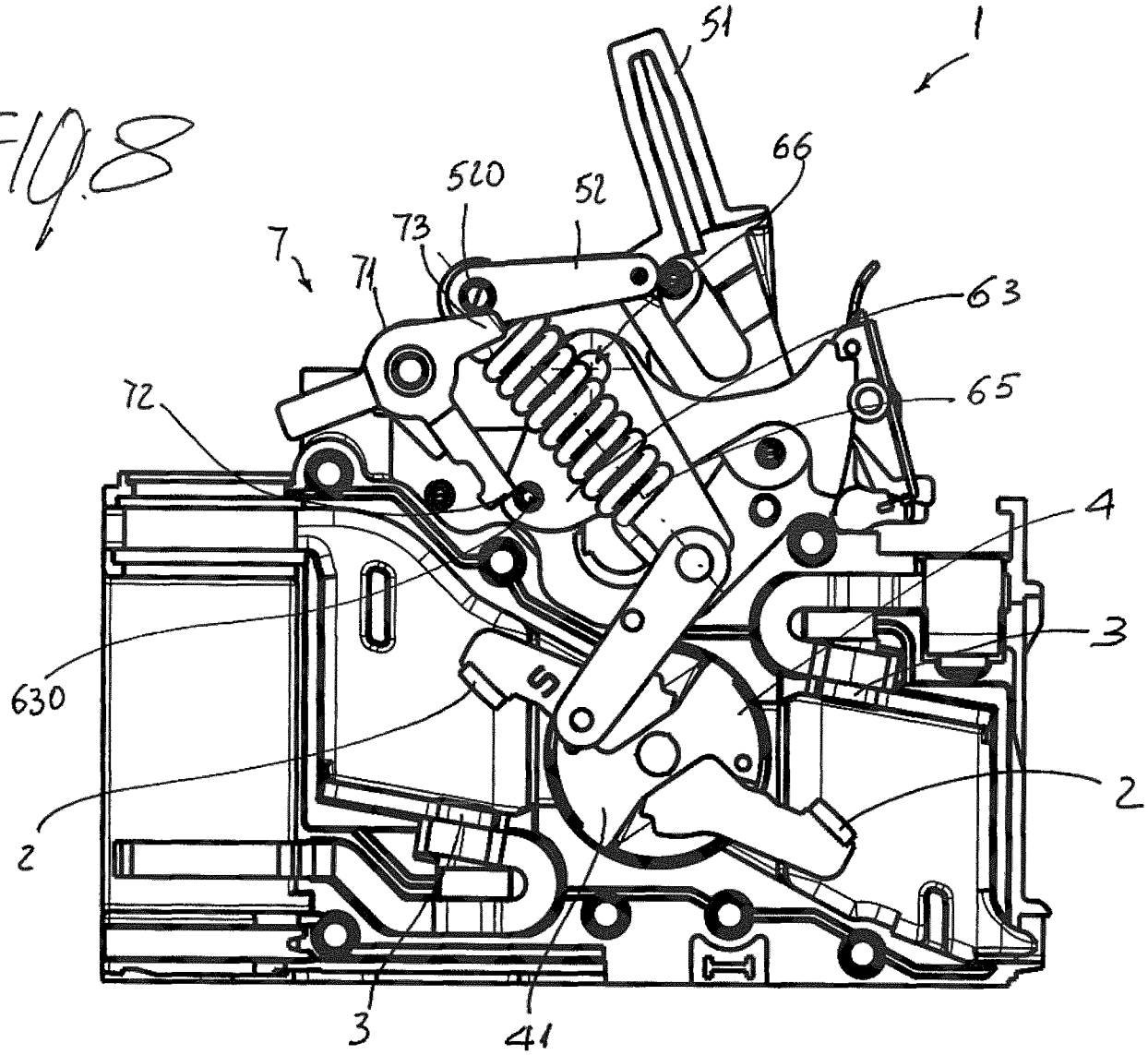
Figure 11:
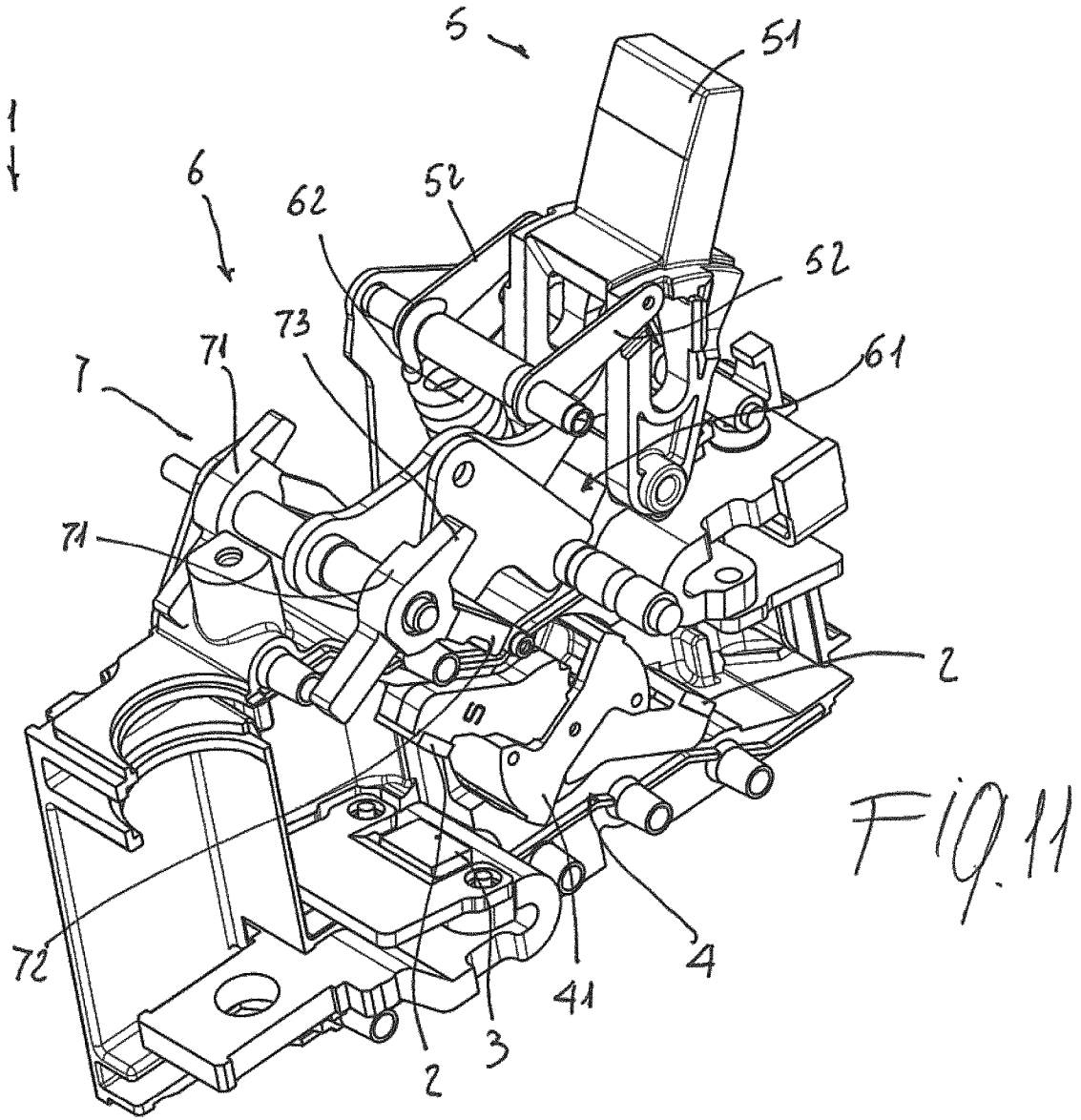
FIGS. 11-16 are perspective views of the opening sequence of the pole for a low-voltage switching device which show the same successive stages represented in previous FIGS. 5-10.
Figure 12:
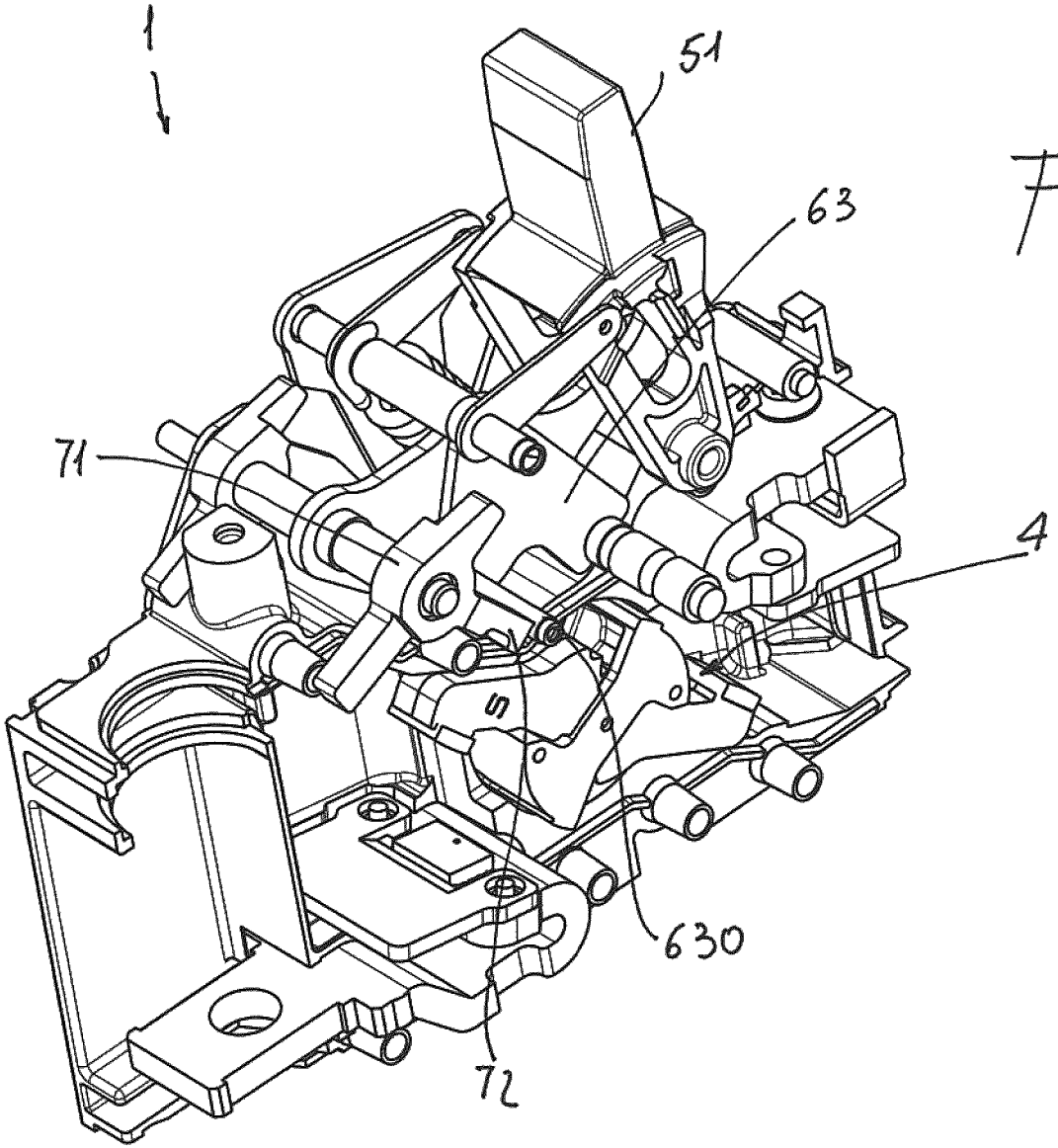
Figure 13:
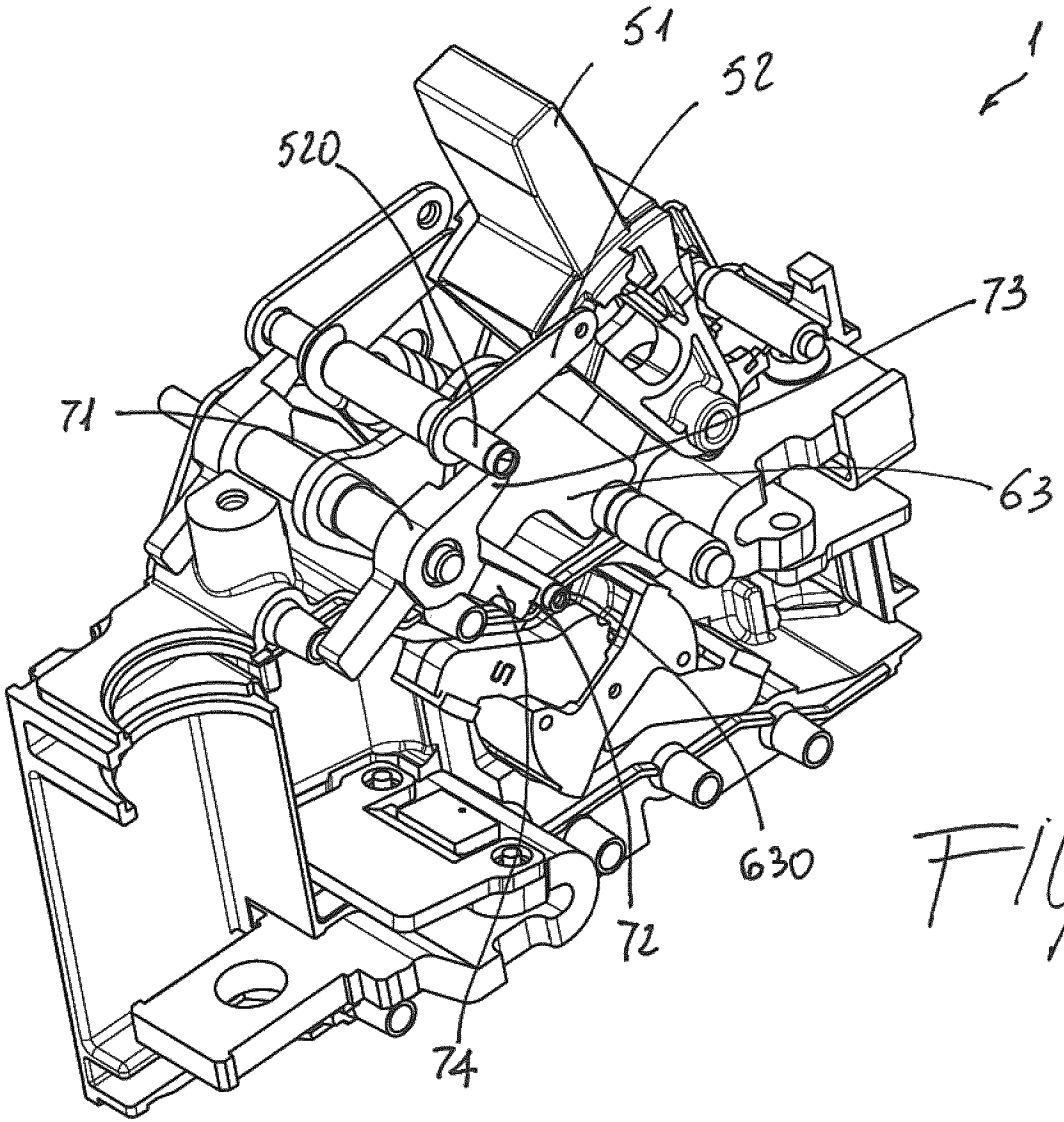
Figure 14:
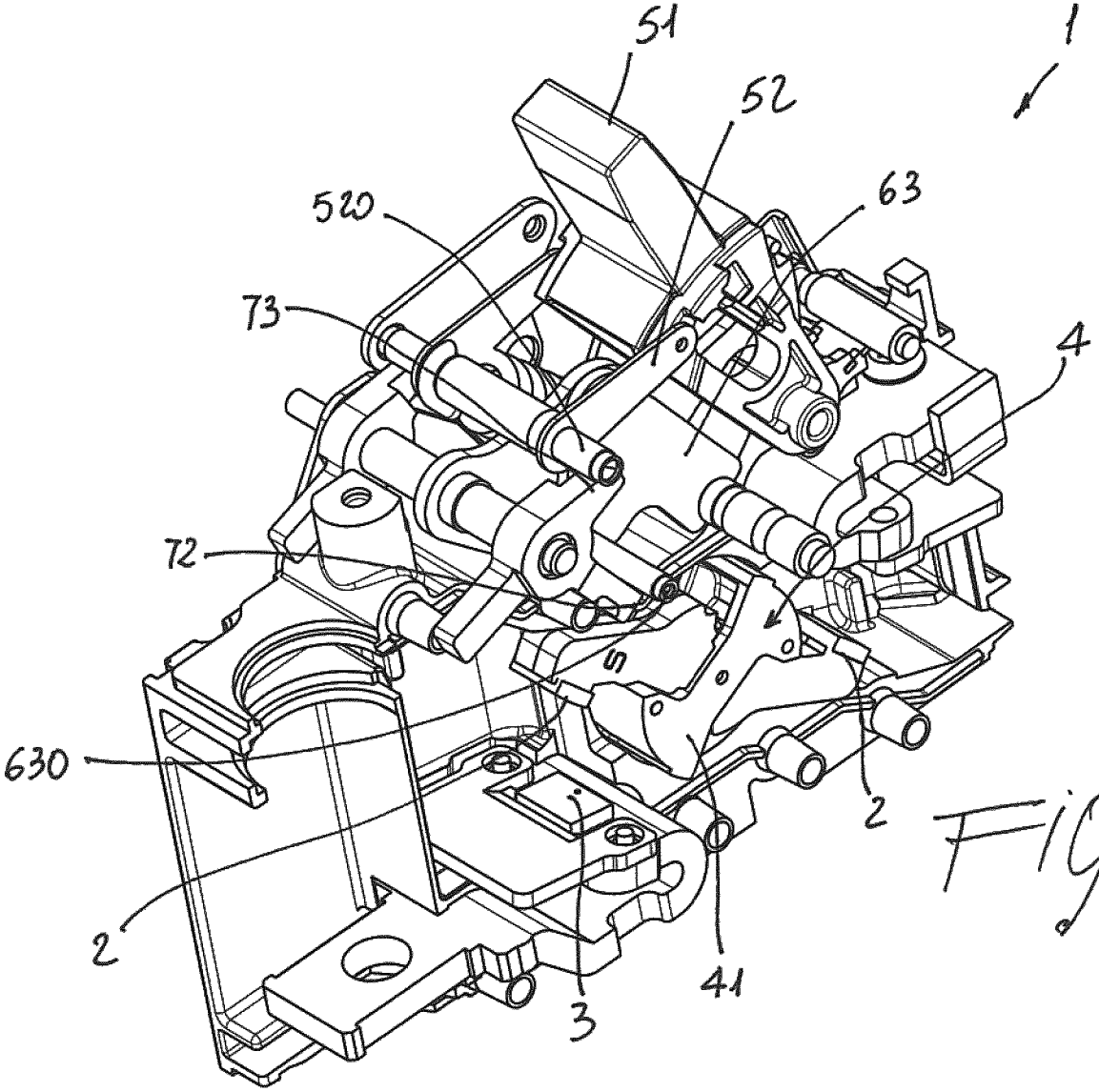

With reference to FIGS. 5 and 11, in the open position of the switching device, the movable contacts 2 are spaced apart from the corresponding fixed contacts 3 and the operating handle 51 is in the open position.

At the beginning of the closing operation (FIGS. 6 and 12), the operating handle is actuated and the operating assembly 5 starts moving. The latching portion 72 of the second end 74 of the latching lever urges against the shaft 630 hinged on the first driving lever 63, thereby preventing any movement thereof.

As the closing operation proceeds (FIGS. 7 and 13), the first operating lever 52 of the operating assembly 5 gets closer to the latching element 71, while the first driving lever 63 is always kept in its position by the action of the latching portion 72 of the second end 74 of the latching lever on the shaft 630.

At the un-latching point (FIGS. 8 and 14) the shaft 520 hinged on the first operating lever 52 urges against the first end 73 of the latching element determining its rotation (clockwise in the figures). As a consequence, the latching portion 72 of the second end 74 of the latching element 71 is moved away from the shaft 630, thereby freeing the first driving lever 63 which from this moment is free to move under the action of the spring 62. As previously explained, the unlatching of the first driving lever 63 takes place substantially when the axis 65 of the driving spring 62 crosses said transverse axis 66.

Figure 9:
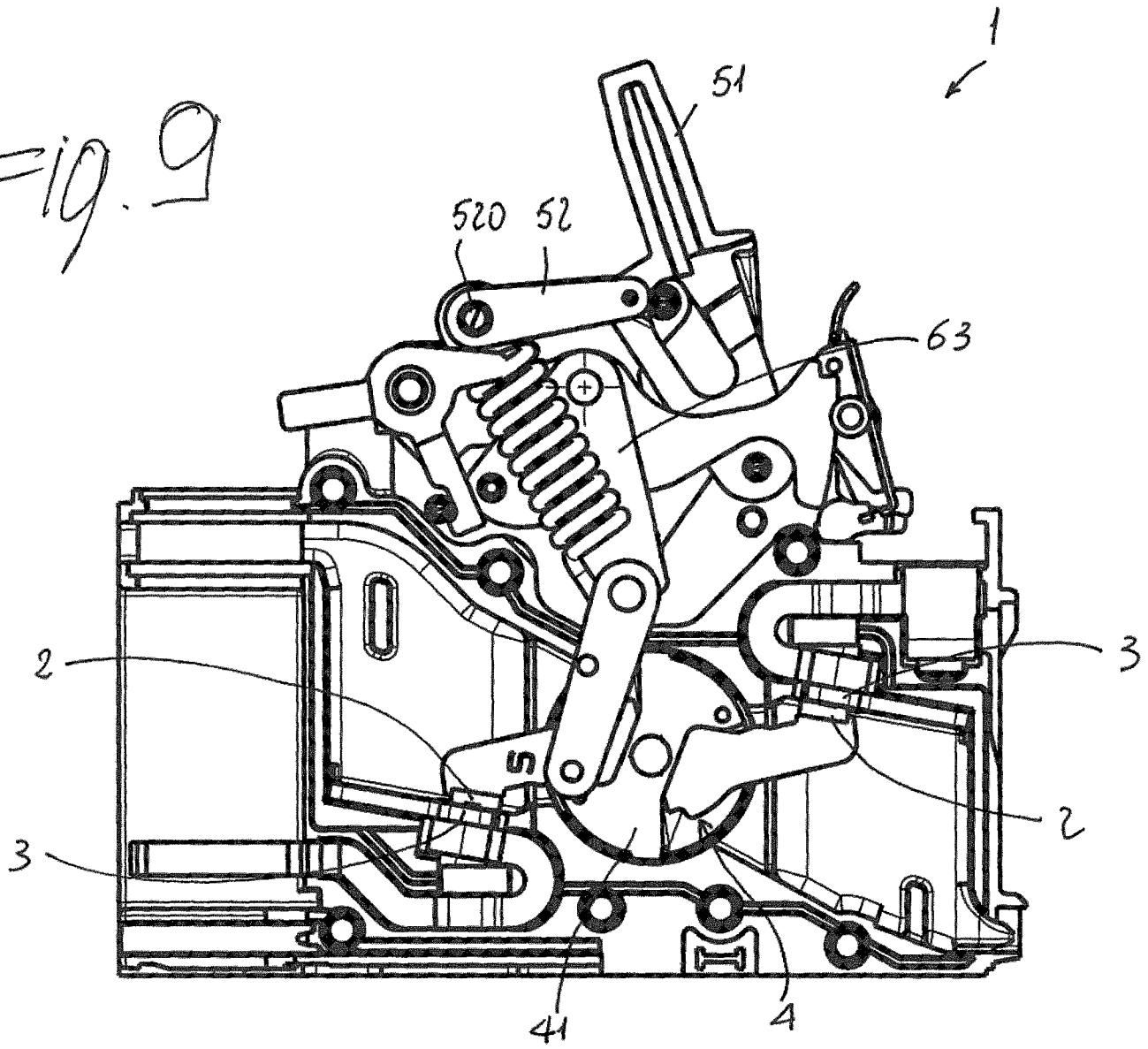
Figure 10:
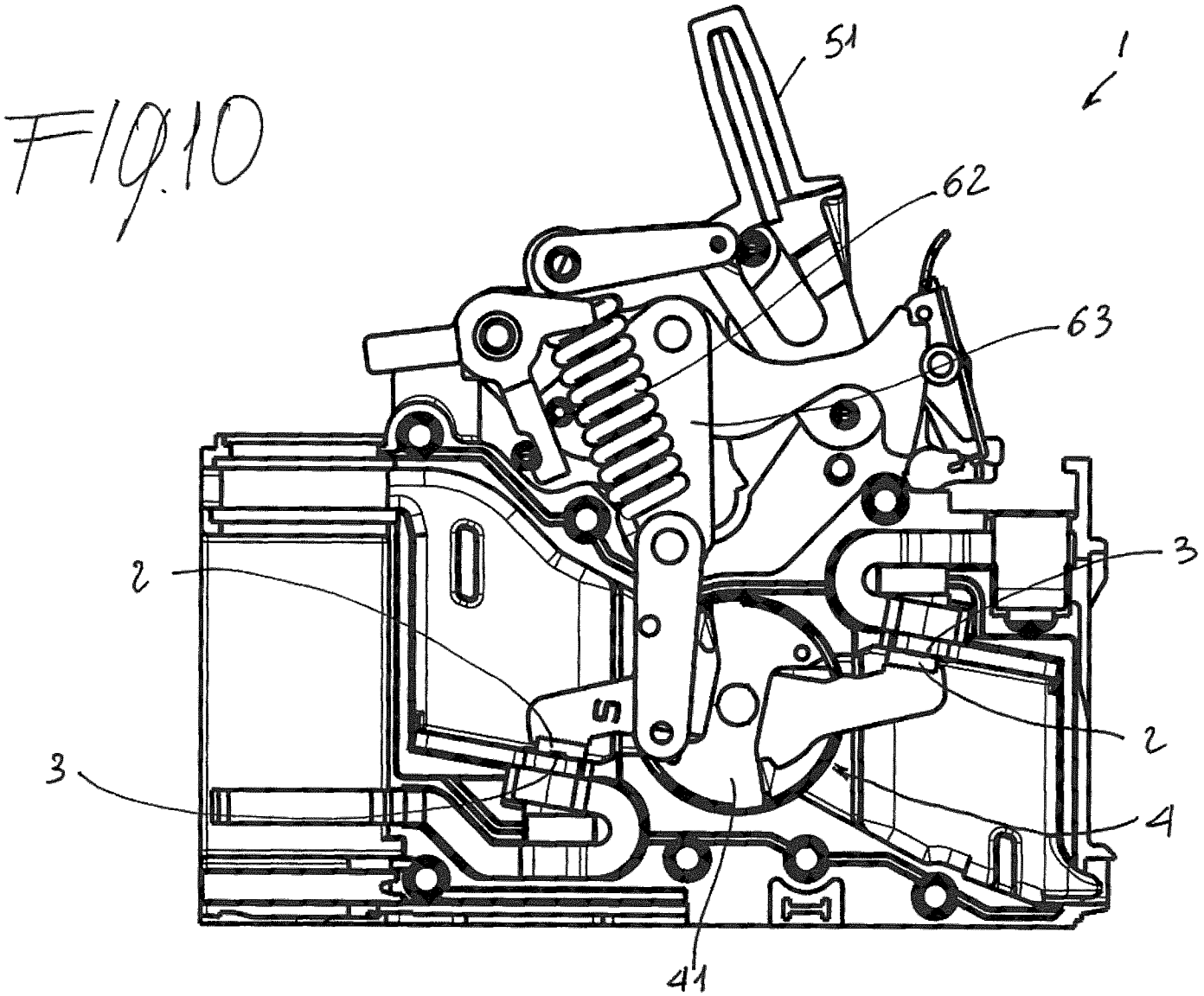
FIG. 10 is a side view of a first embodiment of a pole for a low-voltage switching device according to the invention, shown in the closed position.
Figure 15:
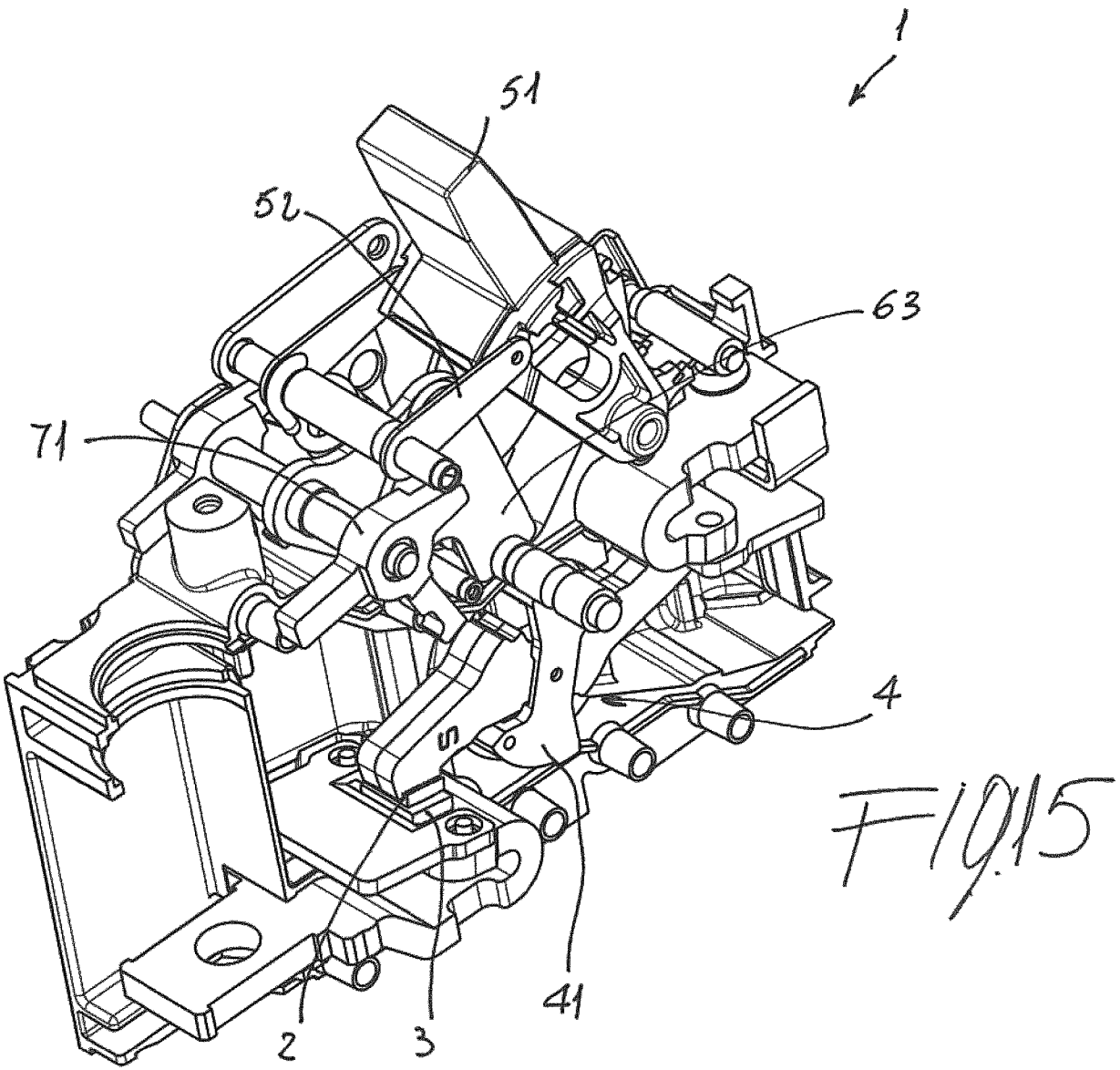
Figure 16:
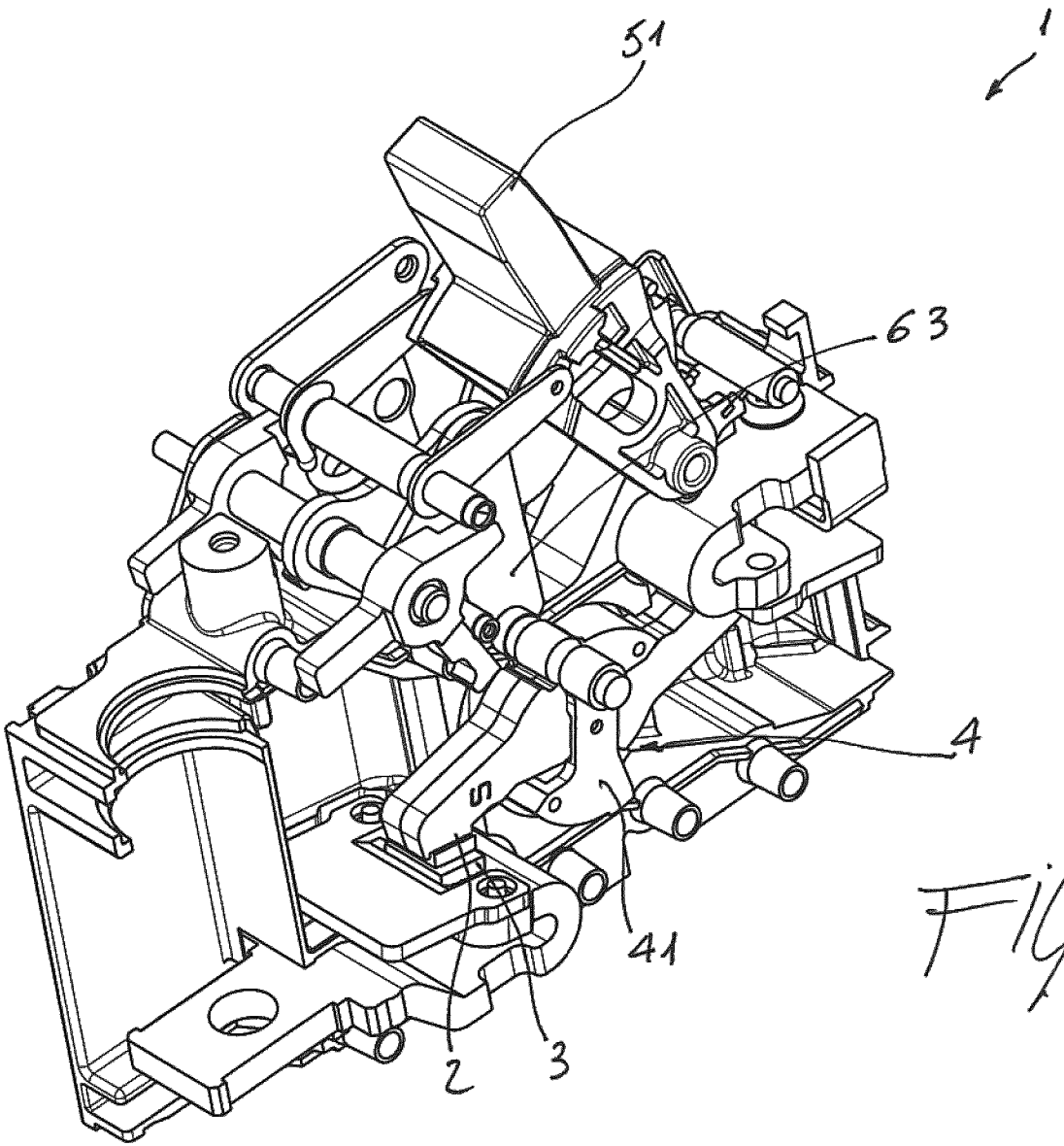

The first driving lever 63 is operatively coupled to the movable contact assembly 4 which is therefore now free to rotate and bring the movable contacts 2 in the contact position of FIGS. 9 and 15, where they are operatively coupled to the corresponding fixed contacts. In this situation, the main supporting and operating shaft 41 continues to rotates of a certain angle (pressing angle) and moves to the third contact position, shown in FIGS. 10 and 16. In such position, the movable contacts 2 and the fixed contacts 3 are coupled to each other and kept pressed against each other, while the main supporting and operating shaft 41 is extra-rotated with respect to them by a suitable pressing angle.

The functioning of a second exemplary embodiment of a low voltage switching device according to the invention will be now described with reference to FIGS. 17-20, will some details of a component of such embodiment will be described with reference to FIGS. 21 and 22*a*-22*c*.

In such embodiment, the low voltage switching device is provided with a latching element 81 which is positioned on a movable part of said operating assembly 5. In particular, said latching element 81 is advantageously fixed on a second operating lever 53 which is connected to the handle mechanism of the switching device.

With reference to FIGS. 22*a*-22*c*, in a preferred embodiment of the present invention, the latching element 81 is integrally made on one of the operating lever 53 of the operating assembly 5 which is connected to said handle actuator 51.

The latching element 81 is conveniently provided with a latching portion 82 which is adapted to cooperate with a second driving lever 64 operatively connected to said movable contact assembly 4. The second driving lever 64 is rotationally hinged on a transverse axis 67 parallel to the rotation axis 40 of the movable contact assembly 4. A first end of the driving spring 62 is fixed on a pivot point of said second operating lever 53, while a second end of said driving spring 62 is fixed on a pivot point on said second driving lever 64 which is operatively connected to the movable contact assembly 4.

More in details, the latching element 81 is integrally made on the second operating lever 53 and its movement is therefore guided by the movement of said second operating lever 53 during its movement under the action of the handle 51. The latching portion 82 of the latching element 81 in turn cooperates with a shaft 640 which is hinged on said second driving lever 64, as explained hereinafter.

Figure 17:
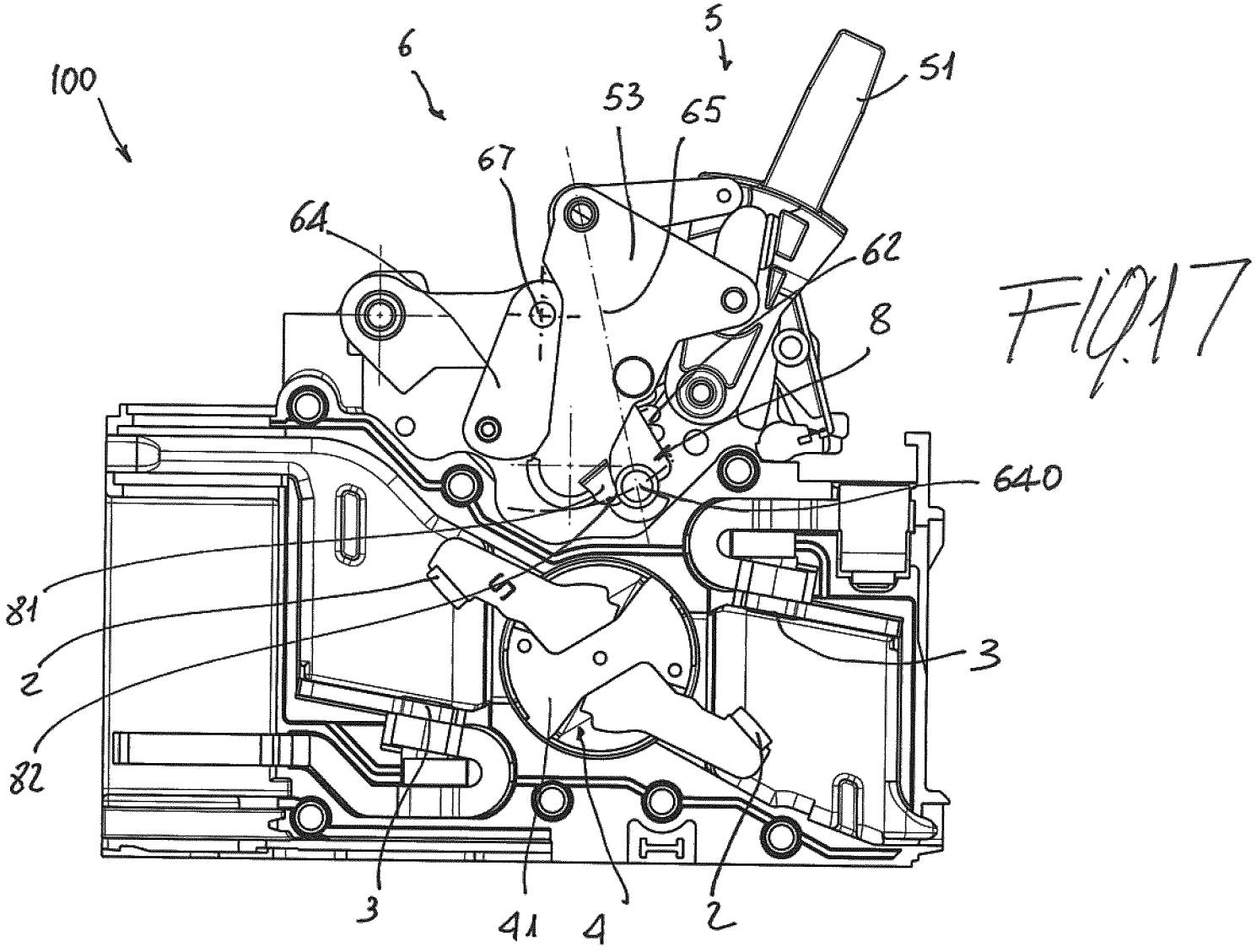
FIG. 17 is a side view of a second embodiment of a pole for a low-voltage switching device according to the invention, shown in the open position.
Figure 18:
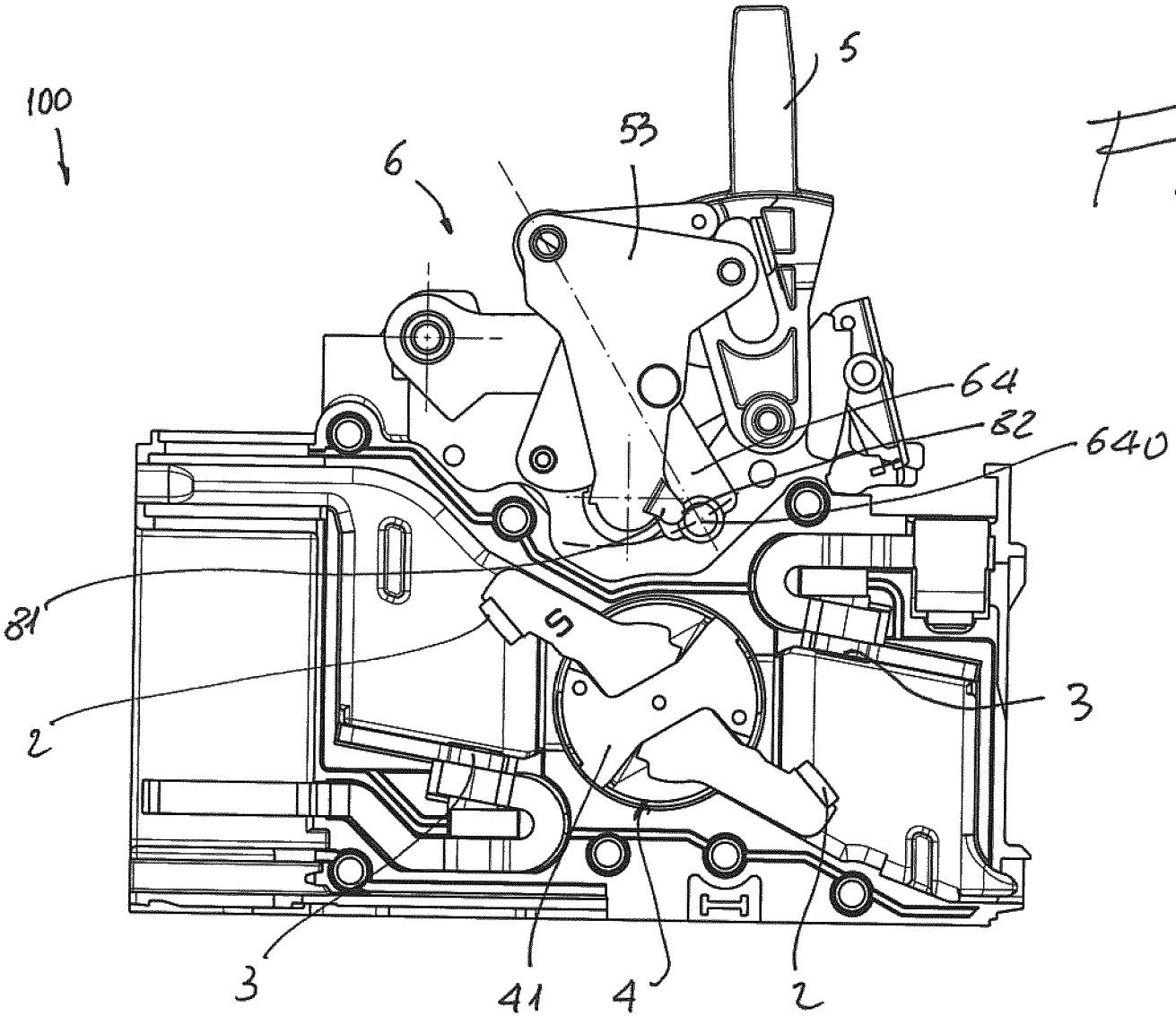
FIGS. 18-19 are side views of a second embodiment of a pole for a low-voltage switching device according to the invention, representing different successive stages of the closing operation.

With reference to FIG. 17, in the open position of the switching device, the movable contacts 2 are spaced apart from the corresponding fixed contacts 3 and the operating handle 51 is in the open position, while the shaft 640 rest on the latching portion 82 of the latching element 81.

As the closing operation proceeds (FIG. 18), the second operating lever 53 of the operating assembly 5 moves and so does the latching element 81 solidly fixed to it. During this initial movement, the latching portion 82 of the latching element 81 slides on the shaft 640 hinged on the second driving lever 64, thereby preventing any movement thereof.

Figure 19:
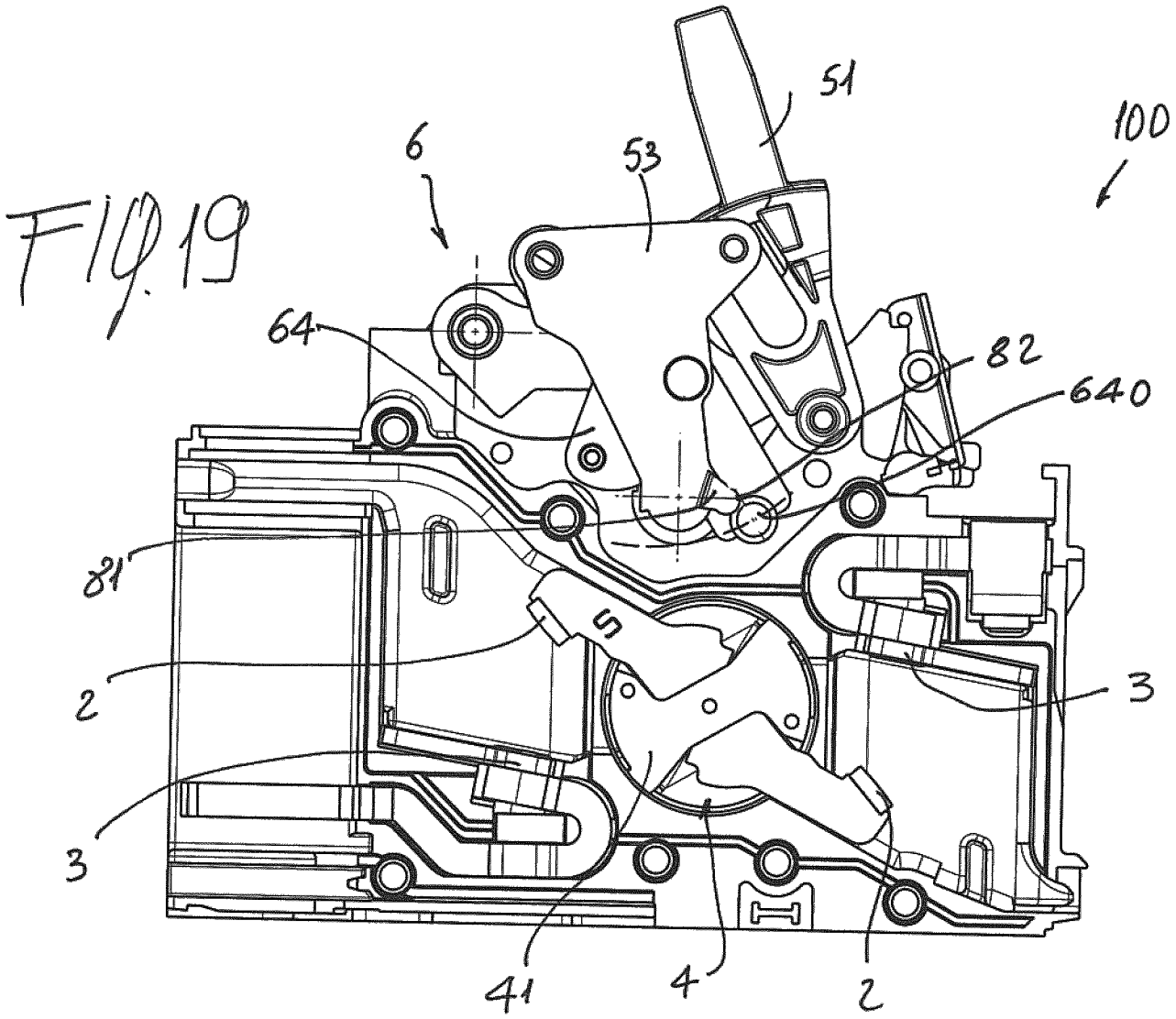

At the un-latching point shown in FIG. 19 the shaft 640 hinged on the second driving lever 64 is freed, thereby freeing the second driving lever 64 which from this moment is free to move under the action of the spring 62. Also in this case, the unlatching of the second driving lever 64 takes place substantially when the axis 65 of the driving spring 62 crosses said transverse axis 67.

Figure 20:
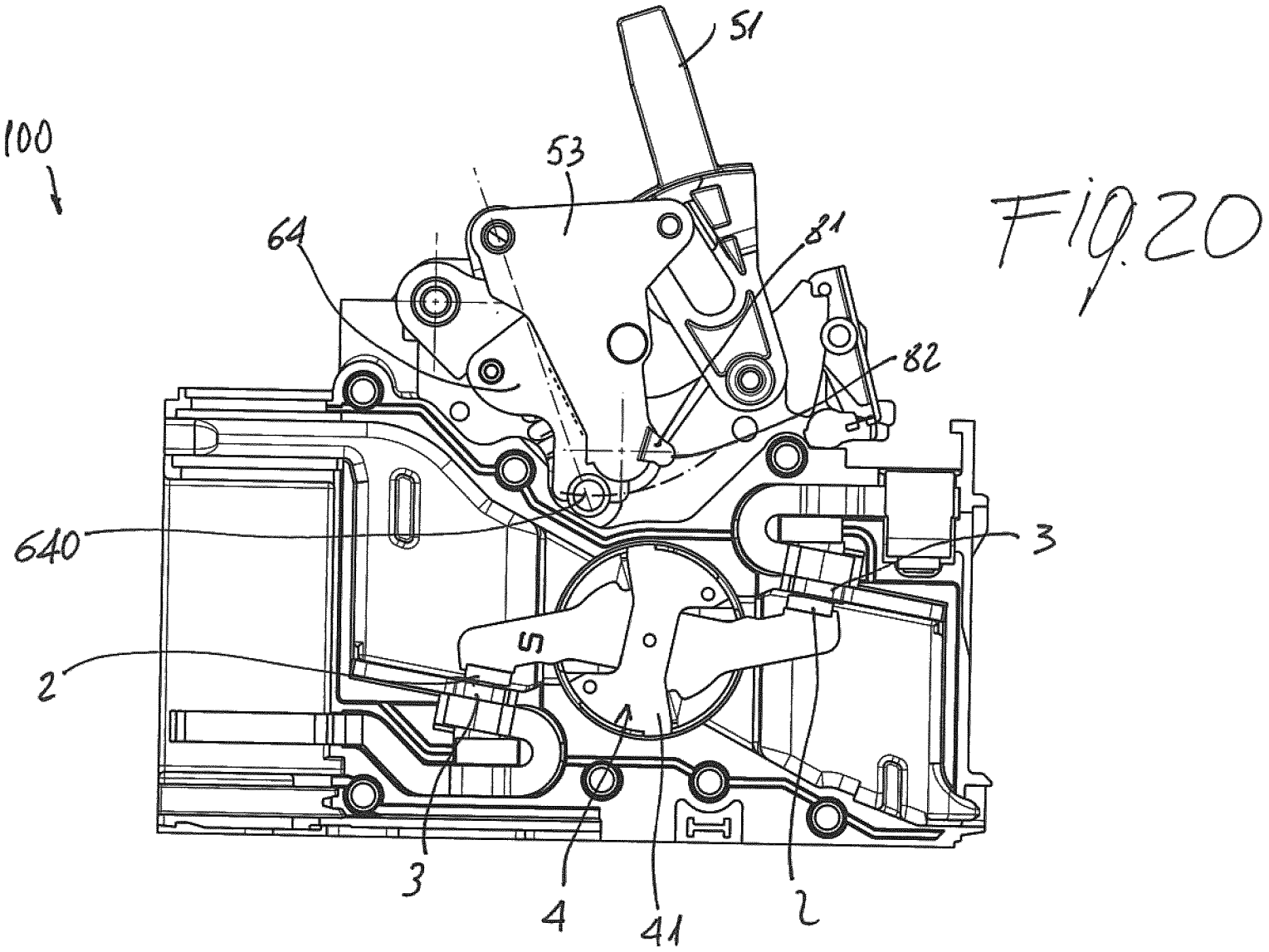
FIG. 20 is a side view of a second embodiment of a pole for a low-voltage switching device according to the invention, shown in the closed position.

The second driving lever 64 is operatively coupled to the movable contact assembly 4 which is therefore now free to rotate and bring the movable contacts 2 and the main supporting and operating shaft 41 to the third contact position, shown in FIG. 20. In such position, the movable contacts 2 and the fixed contacts 3 are coupled to each other and kept pressed against each other, while the main supporting and operating shaft 41 is extra-rotated with respect to them by a suitable pressing angle.

Figure 21:
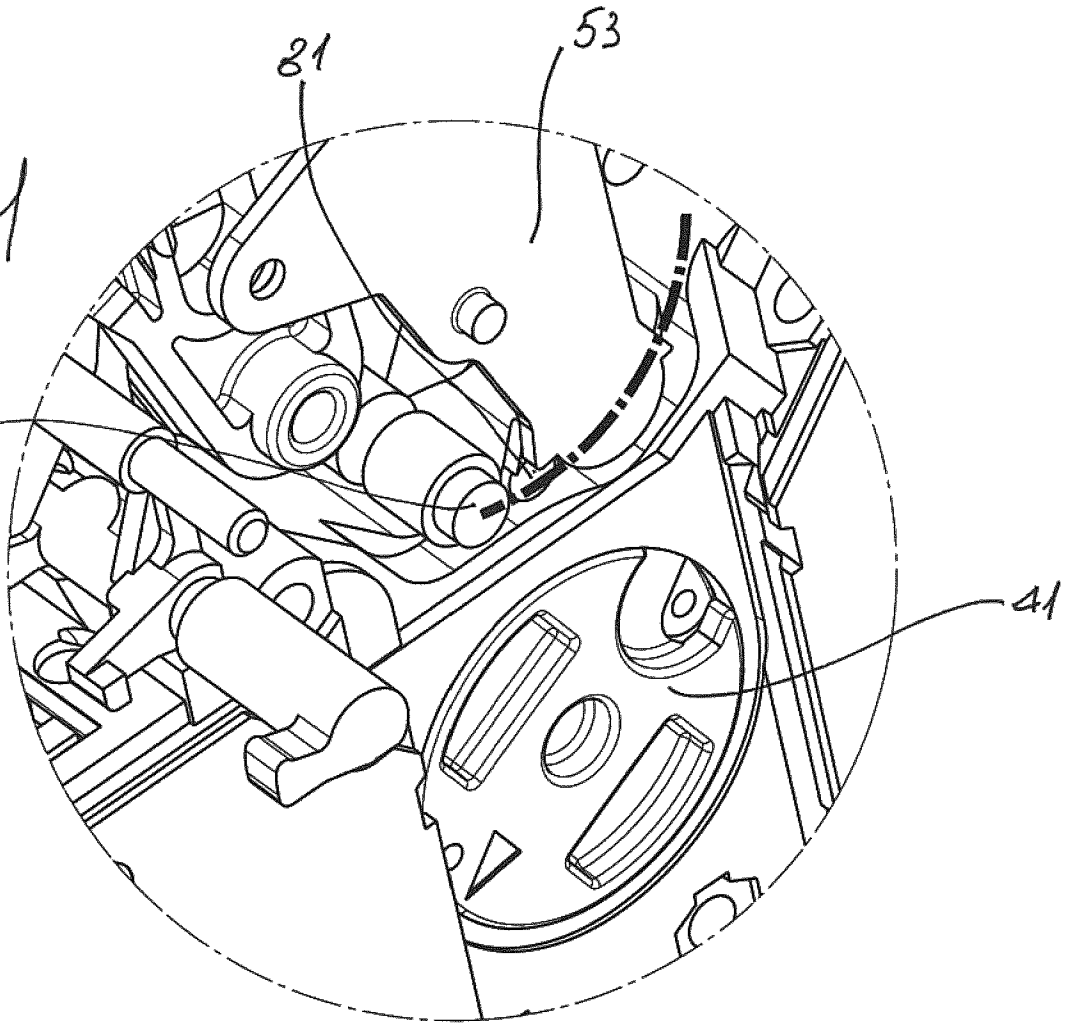
FIG. 21 is an enlarged perspective view of a detail of a second embodiment of a pole for a low-voltage switching device according to the invention.

A detailed view of the movement and trajectory of the latching element 81 with respect to the second driving lever 64 and the corresponding shaft 640 is represented in FIG. 21.

It is clear from the above description that the low voltage switching device of the present invention, fully achieve the intended aims and solved the above-highlighted problems.

In practice, as previously explained, the presence of the latching mechanism allows to achieve always the conditions of quick opening manoeuvre irrespective of the speed of actuation of the operating handle, since the dynamic of the closing operation is always independent from the dynamic of actuation of the operating assembly.

Indeed, the main supporting and operating shaft is always provided with the proper kinetic energy so as to be able to carry out the contacts coupling and to reach the proper pressing angle thereby ensuring the proper pressing action on the contacts when the switching device is the closed condition.

Although being applicable to a broad range of low voltage switching devices, the present invention is particularly suitable in the field of Molded Case Circuit Breakers for low voltage applications.

Several variations can be made to the low voltage switching device thus conceived, all falling within the scope of the attached claims. In practice, the materials used and the contingent dimensions and shapes can be any, according to requirements and to the state of the art.

The invention claimed is:

1. A low voltage switching device comprising:

one or more electric poles, each electric pole comprising one or more movable contacts and one or more corresponding fixed contacts adapted to be coupled to or uncoupled from each other;

a movable contact assembly comprising said movable contacts and a main supporting and operating shaft reversibly movable between a first contact position, at which said movable contacts and said fixed contacts are uncoupled, a second contact position, at which said movable contacts and said fixed contacts are coupled, and a third contact position, at which said movable contacts and said fixed contacts are coupled and kept pressed;

an operating assembly comprising a handle mechanism having a handle adapted to be reversibly moved by a user or a motor operated actuator (MOE) between a first, open position and a second, closed position; and a driving assembly operatively connected to said operating assembly and to said movable contact assembly and comprising a kinematic chain and at least a driving spring, said driving assembly reversibly moving said movable contact assembly following a movement of said operating assembly from said first, open position to said second, closed position, and vice-versa, wherein said driving assembly comprises a latching mechanism which is operatively coupled to said operating assembly and to said movable contact assembly, said latching mechanism interacting with said movable contact assembly and latching said movable contact assembly in said first contact position during a first phase of the movement of said operating assembly between said first, open position and said second, closed position, then unlatching said movable contact assembly when said operating assembly is in an intermediate position between said first, open position and said second, closed position, thereby allowing quick passage of said movable contact assembly from said first contact position to said third contact position in which said movable contacts and said fixed contacts are coupled and kept pressed, wherein said latching mechanism comprises a latching element movable between a first latching position and a second un-latching position, wherein said latching element comprises a latching lever having a first end adapted to cooperate with a first operating lever connected to said handle mechanism and a second end having a latching portion adapted to cooperate with a first driving lever operatively connected to said movable contact assembly, and wherein said first end of said latching lever cooperates with a shaft hinged on said first operating lever and the latching portion of the second end of said latching lever cooperates with a shaft hinged on said first driving lever.

2. The low voltage switching device, according to claim 1, wherein said movable contact assembly is rotationally movable around an axis between said first, second and third contact positions, said movable contacts following said main supporting and operating shaft during rotational movement of said movable contact assembly from said first to said second contact position in which said movable contacts are coupled with the corresponding fixed contacts and remaining in such position while said main supporting and operating shaft moves from said second to said third contact position in which said movable contacts and said fixed contacts are coupled and kept pressed.

3. The low voltage switching device according to claim 1, wherein said latching element is moved from said first latching position to said second unlatching position by the first operating lever.

4. The low voltage switching device according to claim 3, wherein said first driving lever is rotationally hinged on a transverse axis and begins to move when an axis of the driving spring crosses said transverse axis.

5. The low voltage switching device according to claim 4, wherein a first end of said driving spring is fixed on a pivot point of said first operating lever, while a second end of said driving spring is fixed on a pivot point on said first driving lever which is operatively connected to the movable contact assembly.

6. The low voltage switching device according to claim 1, wherein said latching element is positioned on a fixed portion of said low voltage switching device.

7. A low voltage switching device comprising:

one or more electric poles, each electric pole comprising one or more movable contacts and one or more corresponding fixed contacts adapted to be coupled to or uncoupled from each other;

a movable contact assembly comprising said movable contacts and a main supporting and operating shaft reversibly movable between a first contact position, at which said movable contacts and said fixed contacts are uncoupled, a second contact position, at which said movable contacts and said fixed contacts are coupled, and a third contact position, at which said movable contacts and said fixed contacts are coupled and kept pressed;

an operating assembly comprising a handle mechanism having a handle adapted to be reversibly moved by a user or a motor operated actuator (MOE) between a first, open position and a second, closed position; and a driving assembly operatively connected to said operating assembly and to said movable contact assembly and comprising a kinematic chain and at least a driving spring, said driving assembly reversibly moving said movable contact assembly following a movement of said operating assembly from said first, open position to said second, closed position, and vice-versa, wherein said driving assembly comprises a latching mechanism which is operatively coupled to said operating assembly and to said movable contact assembly and a second driving lever operatively coupled to said movable contact assembly, said latching mechanism interacting with said movable contact assembly and latching said movable contact assembly in said first contact position during a first phase of the movement of said operating assembly between said first, open position and said second, closed position, then unlatching said movable contact assembly when said operating assembly is in an intermediate position between said first, open position and said second, closed position, thereby allowing quick passage of said movable contact assembly from said first contact position to said third contact position in which said movable contacts and said fixed contacts are coupled and kept pressed, wherein said latching mechanism comprises a latching element movable between a first latching position and a second un-latching position, and wherein said latching element is fixed on a second operating lever connected to said handle mechanism, and wherein said latching element is provided with a latching portion that engages a round shaft hinged on the second driving lever in the first latching position.

8. The low voltage switching device according to claim 7, wherein said latching element is integrally made on the second operating lever.

9. The low voltage switching device according to claim 3, wherein a first end of said driving spring is fixed on a pivot point of said first operating lever, while a second end of said driving spring is fixed on a pivot point on said first driving lever which is operatively connected to the movable contact assembly.

* * * * *